US012129679B1

(12) United States Patent
Flannery et al.

(10) Patent No.: US 12,129,679 B1
(45) Date of Patent: Oct. 29, 2024

(54) PLAYYARD CANOPY

(71) Applicant: Regalo International, LLC, Burnsville, MN (US)

(72) Inventors: Mark A. Flannery, Longboat Key, FL (US); Heidi C. Leighton, Shorewood, MN (US); Kasey L. Pipo, Elko New Market, MN (US); Shannon R. Bickel, Lakeville, MN (US)

(73) Assignee: Regalo International, LLC, Burnsville, MN (US)

( * ) Notice: Subject to any disclaimer, the term of this patent is extended or adjusted under 35 U.S.C. 154(b) by 193 days.

(21) Appl. No.: 17/584,328

(22) Filed: Jan. 25, 2022

Related U.S. Application Data

(60) Provisional application No. 63/143,746, filed on Jan. 29, 2021.

(51) Int. Cl.

| | |
|---|---|
| ***E04H 15/40*** | (2006.01) |
| ***E04H 15/02*** | (2006.01) |
| ***E04H 15/58*** | (2006.01) |
| *A47D 13/06* | (2006.01) |

(52) U.S. Cl.
CPC ..... *E04H 15/405* (2013.01); *E04H 15/02* (2013.01); *E04H 15/40* (2013.01); *E04H 15/58* (2013.01); *A47D 13/063* (2013.01)

(58) Field of Classification Search
None
See application file for complete search history.

(56) References Cited

U.S. PATENT DOCUMENTS

| | | | | | |
|---|---|---|---|---|---|
| 1,433,457 | A | * | 10/1922 | Hunter | A47C 17/64 135/117 |
| 2,820,468 | A | * | 1/1958 | Park | A47D 7/00 135/117 |
| 2,883,678 | A | * | 4/1959 | Heffernan | A47D 7/00 5/93.1 |
| 3,960,161 | A | * | 6/1976 | Norman | E04H 15/40 135/93 |
| 4,186,454 | A | * | 2/1980 | Cone | A47D 13/063 5/99.1 |
| 4,790,340 | A | * | 12/1988 | Mahoney | A47D 13/06 135/96 |
| 4,945,584 | A | * | 8/1990 | LaMantia | A47D 7/00 135/90 |
| 5,099,866 | A | * | 3/1992 | Solis | A47D 13/063 135/117 |
| D383,625 | S | * | 9/1997 | Dillner | D6/331 |

(Continued)

FOREIGN PATENT DOCUMENTS

| | | | | | |
|---|---|---|---|---|---|
| KR | 200314950 | Y1 | * | 6/2003 | |
| WO | WO-2007001959 | A2 | * | 1/2007 | A45B 23/00 |

*Primary Examiner* — David R Dunn
*Assistant Examiner* — Danielle Jackson

(57) ABSTRACT

A canopy for a playyard. The canopy is elongate and includes sheeting with a resilient element defining the perimeter. A first form of the canopy is generally flat. A second form of the canopy is generally U-shaped. A third form of the canopy is compact with three generally circular shapes. The canopy includes a first flap with a first edge and a second flap with a second edge, wherein the first and second edges run cross-wise to each other when the canopy is in the generally flat form and generally parallel and adjacent to each other when the canopy is in the generally U-shaped form.

10 Claims, 13 Drawing Sheets

(56) References Cited

U.S. PATENT DOCUMENTS

D404,597 S * 1/1999 Chavez ..... D6/333
5,862,548 A * 1/1999 Gerhart ..... A47D 13/06 135/117
5,992,045 A * 11/1999 Kellogg ..... F26B 25/18 34/103
6,098,349 A * 8/2000 Zheng ..... E04H 15/40 52/134
6,123,091 A * 9/2000 Flynn ..... A47D 13/063 135/132
6,595,227 B2 * 7/2003 Le Gette ..... E04H 15/40 5/418
6,901,940 B2 * 6/2005 Zheng ..... E04H 15/40 135/133
7,302,957 B2 * 12/2007 Ross ..... E04H 15/40 135/117
7,308,989 B2 * 12/2007 Zheng ..... E04H 15/40 220/666
7,699,186 B2 * 4/2010 Zheng ..... E04H 4/0025 4/488
8,899,251 B2 * 12/2014 Leung ..... E04H 15/40 135/96
9,644,390 B1 * 5/2017 Garvens ..... A47C 21/00
D794,989 S * 8/2017 Aker ..... D6/718.29
D813,583 S * 3/2018 Furuland ..... D6/718.29
10,194,755 B1 2/2019 Flannery et al.
10,448,752 B1 10/2019 Flannery et al.
10,557,282 B1 2/2020 Flannery et al.
10,674,835 B1 6/2020 Flannery et al.
10,905,254 B2 * 2/2021 Gutman ..... A47C 15/008
10,968,658 B2 * 4/2021 Furuland ..... E04H 15/40
11,109,691 B2 * 9/2021 Fusco ..... A47D 13/061
11,266,253 B1 * 3/2022 Flannery ..... A47D 9/00
11,391,056 B1 * 7/2022 Flannery ..... A47C 29/003
11,732,497 B1 * 8/2023 Flannery ..... E04H 15/28 135/98
11,737,578 B1 * 8/2023 Bickel ..... A47D 13/063 5/99.1
2016/0324324 A1 * 11/2016 Wilkerson Altonen ..... E04H 15/003
2019/0200781 A1 * 7/2019 McGittigan ..... A47D 13/063

* cited by examiner

PLAYYARD CANOPY

This application claims the benefit under 35 U.S.C. 119 (e) of U.S. Provisional Patent Application No. 63/143,746 filed Jan. 29, 2021 and entitled Playyard Canopy, which application is hereby incorporated by reference in its entirety into this application.

FIELD OF THE INVENTION

The present invention generally relates to a canopy, particularly to a canopy for a playyard, and specifically to a canopy that can be resiliently drawn into different forms.

BACKGROUND OF THE INVENTION

When it comes to canopies, big is good. A bigger canopy provides a greater area of shade. A bigger canopy requires less adjustment as the sun moves across the sky. A bigger canopy minimizes the chances that rain will spoil the day.

SUMMARY OF THE INVENTION

A feature of the present invention is the provision in a canopy for a playyard, of sheeting, where the sheeting includes first and second ends, where the sheeting includes first and second sides, where the sheeting includes an elongate shape, where the sheeting includes a resilient element engaged thereto, where the resilient element defines a perimeter of the sheeting, and where the resilient element is generally endless.

Another feature of the present invention is the provision in a canopy for a playyard, of the sheeting having a first form that is generally a flat form, where the first and second ends are spaced apart in the first form.

Another feature of the present invention is the provision in a canopy for a playyard, of the sheeting having a second form that defines the shape of a U, where the resilient element is tensioned in the second form, where the first and second ends are spaced apart from each other in the second form, and where the first and second ends are closer to each other in the second form than in the first form.

Another feature of the present invention is the provision in a canopy for a playyard, of the sheeting having a third form where the resilient element defines three generally similar shapes adjacent to each other.

Another feature of the present invention is the provision in a canopy for a playyard, of the sheeting extending from the first end to the second end and from the first side to the second side.

Another feature of the present invention is the provision in a canopy for a playyard, of first, second, third, and fourth flaps, where the first and second flaps are engaged to the first side of the sheeting, and where the third and fourth flaps are engaged to the second side of the sheeting.

Another feature of the present invention is the provision in a canopy for a playyard, of the first flap opposing the third flap in the first and second forms and of the second flap opposing the fourth flap in the first and second forms, where the first and second flaps are engagable to each other in the second form, and where the third and fourth flaps are engagable to each other in the second form.

Another feature of the present invention is the provision in a canopy for a playyard, of the first flap opposing the third flap in the first and second forms and of the second flap opposing the fourth flap in the first and second forms, where the first and second flaps include respective edge portions that are disposed transversely to each other in the first form and adjacent to each other in the second form, and where the third and fourth flaps include respective edge portions that are disposed transversely to each other in the first form and adjacent to each other in the second form.

Another feature of the present invention is the provision in a canopy for a playyard, of the first flap opposing the third flap in the first and second forms and of the second flap opposing the fourth flap in the first and second forms, where the first and second flaps include respective edge portions that are disposed diagonally relative to a sheeting axis in the first form and generally in line with each other in the second form, and where the third and fourth flaps include respective edge portions that are disposed diagonally relative to the sheeting axis in the first form and generally in line with each other in the second form.

Another feature of the present invention is the provision in a canopy for a playyard, of the first flap opposing the third flap in the first and second forms and of the second flap opposing the fourth flap in the first and second forms, where the first and second flaps include respective resilient edge portions and respective end portions that are engagable to each other in the second form when the respective resilient edge portions are stretched, and where the third and fourth flaps include respective resilient edge portions and respective end portions that are engagable to each other in the second form when the respective resilient edge portions are stretched.

Another feature of the present invention is the provision in a canopy for a playyard, of the sheeting defining an elongate shape.

Another feature of the present invention is the provision in a canopy for a playyard, of the sheeting defining an oblong shape.

Another feature of the present invention is the provision in a canopy for a playyard, of the resilient element being generally endless.

Another feature of the present invention is the provision in a canopy for a playyard, of the resilient element being tensioned in the second form.

Another feature of the present invention is the provision in a canopy for a playyard, of the sheeting including a third form where the resilient element defines three generally similar shapes adjacent to each other.

Another feature of the present invention is the provision in a canopy for a playyard, of a first connector on the first end of the canopy, where the first connector includes first and second portions that are spaced apart from each other, where the first and second portions of the first connector are engagable to each other while a first object is disposed between the first connector and the sheeting.

Another feature of the present invention is the provision in a canopy for a playyard, of a second connector on the second end, where the second connector includes first and second portions that are spaced apart from each other, where the first and second portions of the second connector are engagable to each other while a second object is disposed between the second connector and the sheeting.

Another feature of the present invention is the provision in a canopy for a playyard, of a flexible pen, where the flexible pen includes first, second, third, and fourth flexible sidewalls, a flexible floor, and an open top, where the first and third flexible sidewalls are opposite of one another, where the second and fourth flexible sidewalls are opposite of one another, where the first flexible sidewall is adjacent to the second flexible sidewall which in turn is adjacent to the third flexible sidewall which in turn is adjacent to the fourth flexible sidewall which in turn is adjacent to the first flexible sidewall.

Another feature of the present invention is the provision in a canopy for a playyard, of a scissoring frame, where the flexible pen is inside of the scissoring frame, where the frame includes first, second, third, and fourth pairs of first and second support members, where each of the first, second, third, and fourth pairs of first and second support members are adjacent to, respectively, the first, second, third, and fourth flexible sidewalls, where first and second support members of a same pair are pivotally engaged to each other at an intermediate junction, where first and second support members of adjacent pairs are pivotally engaged to each other at upper junctions, and where first and second support members of adjacent pairs are pivotally engaged to each other at lower junctions.

Another feature of the present invention is the provision in a canopy for a playyard, of the first end of the canopy engaging the first pair of first and second support members, and of the second end of the canopy engaging the third pair of the first and second support members.

An advantage of the present invention is that the canopy is relatively large in an operational form and relatively small and compact in a stored form.

Another advantage of the present invention is that the canopy is relative light (has relatively little mass) such that the canopy is easy to carry in either the large operating form or the small compact form.

Another advantage of the present invention is that the canopy provides shade for the entirety of the playyard. For example, the elongate portion of the canopy provides a portion of such shade and the four triangular flaps provide another portion of such shade.

Another advantage is that the canopy engages an open top playyard so as to generally cover the entire open top and render the playyard essentially bug-free.

Another advantage of the present invention is that the canopy is easily and quickly engagable to the playyard. One feature contributing to this advantage is the peg and loop connections that engage to the frame of the playyard. Another feature contributing to this advantage is that the ends of the canopy are tucked between the frame of the canopy and the sidewall of the canopy.

Another advantage of the present invention is that airflow may be restricted into the playyard by the canopy. For example, all four flaps may be closed.

Another advantage of the present invention is that airflow may be permitted into the playyard by the canopy. For example, two of the same side flaps may be closed and the other two same side flaps may be opened. Or all four of the flaps may be opened. Or diagonally opposed flaps may be opened. Or diagonally opposed flaps may be closed. Or directly opposed flaps may be open while the other directly opposed flaps may be closed.

Another advantage is that is that the canopy is relatively inexpensive and simple to manufacture.

BRIEF DESCRIPTION OF THE DRAWINGS

FIG. 10F shows the compact state.

DESCRIPTION

Figure 1A:
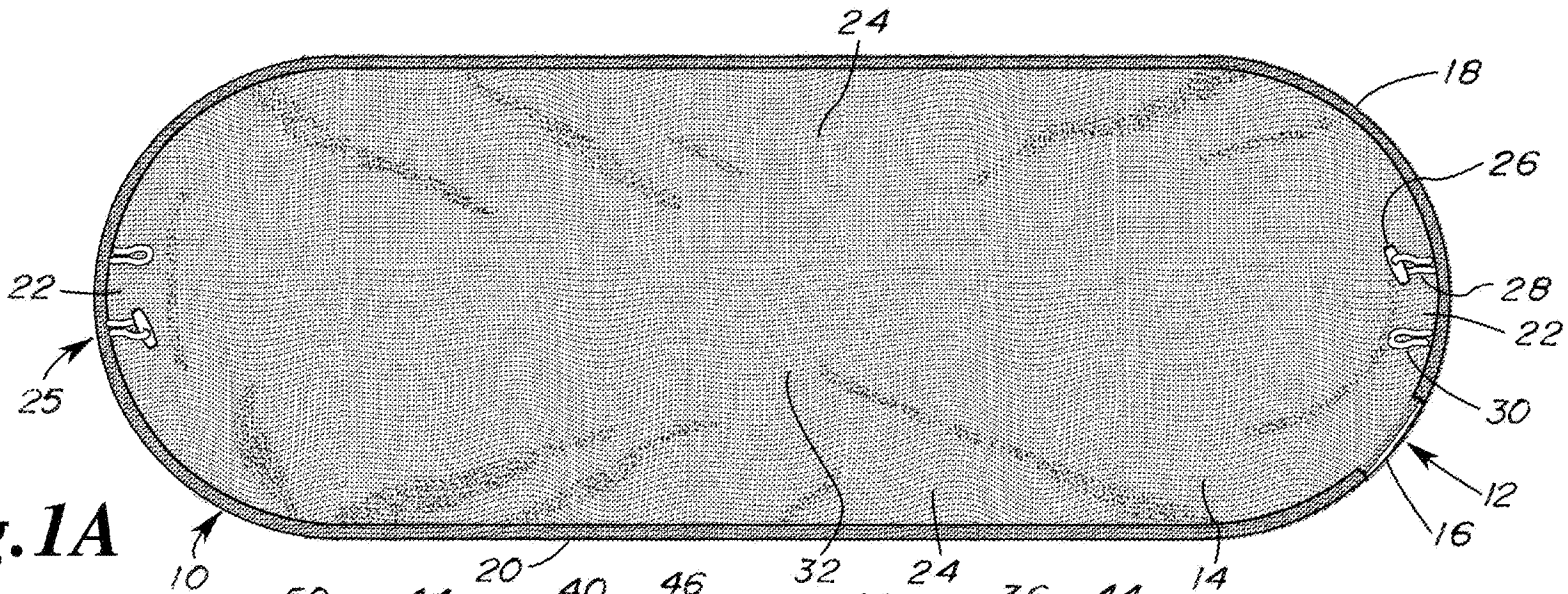
FIG. 1A is a perspective view of the top of the present canopy, where the canopy is in a generally flat state.
Figure 1B:
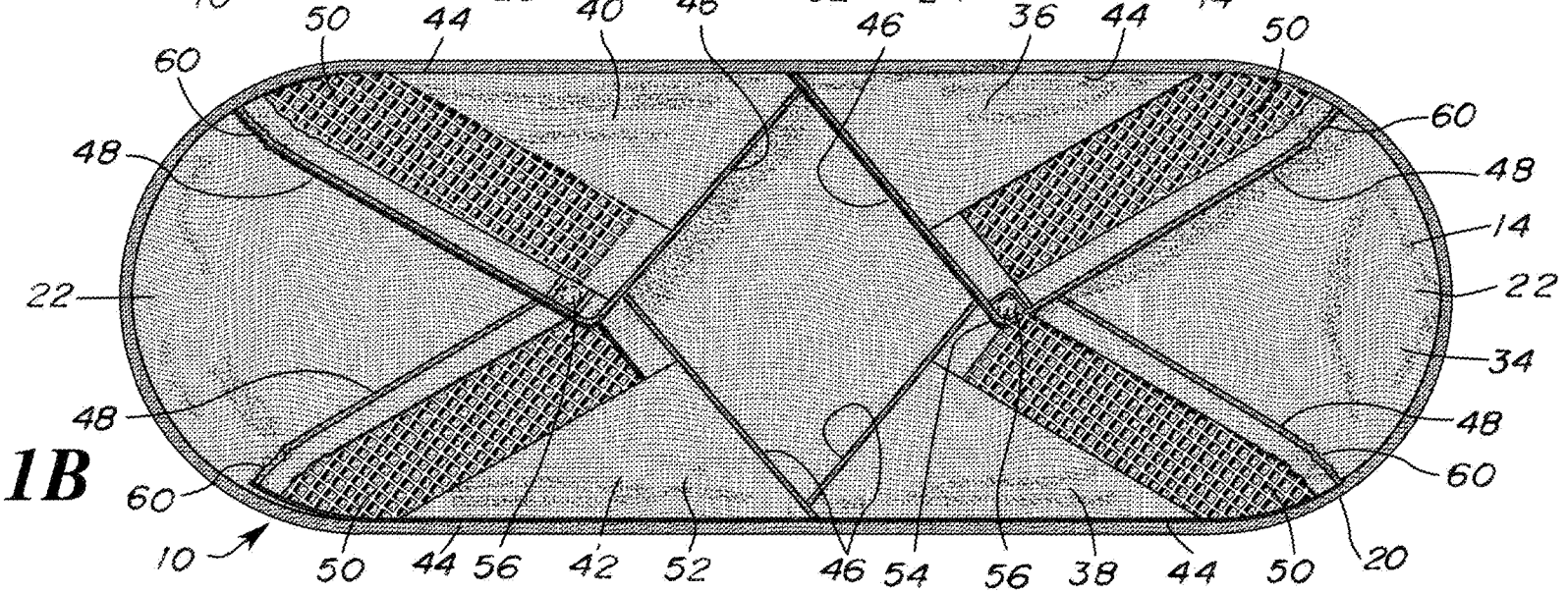
FIG. 1B is a perspective view of the bottom of the canopy of FIG. 1A, where the canopy is in a generally flat state.

As shown in FIGS. 1A and 1B, the present playyard canopy is indicated by the reference numeral 10. Canopy 10 includes a frame 12 and sheeting 14.

Frame 12 includes a resilient element 16 that extends about a perimeter 18 of sheeting 14. Ends of the resilient element 14 are engaged to each other such as by a tube or metal tubular coupler 19 shown in FIG. 13. Frame 12 includes resilient element 16 and tube 19. Resilient element 16 is preferably a solid resilient fiberglass rod. Resilient element 16 may be a rod, tube, or flat strip. Resilient element 16 may be formed of fiberglass, nylon, a polymer, a plastic, a blend of polymers, a metal, a composite, or some combination thereof. Resilient element 16 is formed from a material that bends from a straight line form to a circular or curved line form and then returns to the unbent straight line form without any aid from an outside force unless the resilient element 16 is fixed by an outside force that does not permit the resilient element 16 to return to the unbent form. The outside source may be a human hand while folding the resilient element 16 from the flat form shown in FIG. 1A or operational form shown in FIG. 3 to the compact form shown in FIG. 10F. The outside source may be a box, such as a cardboard box used in packaging. The outside source may be a binder or binders such as one of more rubber bands wrapped diametrically across the ready-to-be-packaged form of FIG. 10F. It should be noted that the canopy 10 remains in the compact form shown in FIG. 10F, where circular unit portions are adjacent to each other and generally share a common axis, without the aid of any outside source until one or more circular unit portions are pushed a certain distance away from the other circular unit portions.

Resilient element 16 is contained within an envelope 20 of a flexible fabric material. Envelope 20 extends about an outside edge, an inside edge, an upper face, and a lower face of the resilient element 16. Envelope 20 is a fabric strip folded back on itself such that two edge portions are stitched together, with such stitching further stitching the envelope 20 to sheeting 14. Frame 12, including the resilient element 16 and tube or coupler 19, when released from the three circular unit portions shown in FIG. 13, springs out into a circle form, which form is under tension. Thus, within envelope 20 in the form shown in FIGS. 1A and 1B and endlessly trying to obtain such a circle form, resilient element 16 endlessly pushes outwardly against every portion or every segment of the outer edge of the envelope 20 from inside of the envelope 20.

Sheeting 14 is engaged to the envelope 20. As indicated, envelope 20 may be stitched to sheeting 14, or sheeting 14 and envelope 20 may be integral such as where an edge portion of the sheeting 14 is turned back on itself so as to create an envelope or tube like structure or sleeve or tubular receiver for the resilient element 16.

Sheeting 14 includes opposing ends 22. Sheeting 14 includes opposing sides 24. Sheeting 14 extends from one end 22 to the other end 22. Sheeting 14 extends from one side 24 to the other side 24.

Sheeting 14 takes an elongate or oblong shape. Envelope 20 and resilient element 16 also form an oblong or elongate shape. "Oblong" means a shape that deviates from a square, circular, or spherical form by elongation in one dimension. Resilient element 16 includes opposing parallel portions in the flat form of FIGS. 1A and 1B, where the opposing parallel portions are adjacent to the sides 24. Resilient element 16 includes opposing circular portions in the flat form of FIGS. 1A and 1B, where the opposing circular portions are adjacent to the ends 22.

In the form in FIGS. 1A and 1B, sheeting 14 is taut between the ends 22 and sides 24 because the resilient element 16 is biased toward the circle form. In FIGS. 1A and 1B, sheeting 14 takes a generally flat form and generally defines a plane. However, with the sheeting 14 being taut, canopy 10 may not lie perfectly flat on a surface. Rather, the sheeting 14 may lie somewhat undulated and canopy 10 may be somewhat undulating.

In FIGS. 1A and 1B, opposing ends 22 are spaced apart and sides 24 are spaced apart. While the sheeting 14 is taut, the resilient element 16 is in its base state. The resilient element 16 returns to this form or state automatically and resiliently after being disengaged or released or let free from the constraint or form shown in FIG. 3 and after being disengaged or released or set free from any of the forms or constraints shown in FIGS. 10A, 10B, 10C, 10D, 10E, and 10F.

As shown in FIG. 1A, the canopy 10 includes, at each of the ends 22, a toggle closure or fastening 25 that includes a peg or dowel 26 engaged to the envelope 20 by a pair of elastic strips 28, and a loop 30 formed by an elastic strip. The loop 30 extends from and is engaged to envelope 20. Peg or dowel 26 is inserted into loop 30 for engagement between the peg 26 and loop 30. Loop 30 can engage peg or dowel 26 by being wrapped about the peg 26. Peg 26 and loop 30 extend from an outer face 32 of canopy 10.

The inner face 34 of canopy 10 is shown in FIG. 1B. The endless envelope 20 having the resilient element 16 therein is visible in FIG. 1B as well as FIG. 1A. Endless envelope 20 extends from each of the outer and inner faces 32, 34.

First, second, third, and fourth flaps 36, 38, 40, and 42 are engaged to endless envelope 20 and extend therefrom. Each of the flaps 36, 38, 40, 42 is generally triangular and includes three sides 44, 46, 48. Side 44 is a curved side and is engaged to the endless envelope 20. Side 46 is a vertically oriented side when the canopy 10 is set up in the operational position of FIG. 3. Side 48 is a horizontally oriented side when the canopy 10 is set up in the operation position of FIG. 3. Flaps 36, 38, 40, 42 are foldable or flexible along sides or edges 44.

Each of the flaps 36, 38, 40, 42 is flexible and includes a mesh window portion 50. Mesh window portion 50 is also flexible. Mesh window portion 50 is see-through. The remaining fabric portion is designated by reference number 52, is not see-through, is opaque, blocks the sun, and provides shade. Mesh window portion 50 is elongate and extends from side 44 to just short of side 46. Mesh window portion 50 is spaced from and adjacent to side 46. Mesh window portion 50 is spaced from and adjacent to side 48. Mesh window portion 50 includes four sides, one of which is oblique to the other three sides. Mesh window portion 50 includes two sides that extend parallel to each other and one side that extends at a right angle to two of the other sides.

Between mesh 50 and side or edge 48, fabric portion 52 is double layered. Between mesh 50 and side or edge 46, fabric portion 52 is double layered. Apex portion 54 is double layered with fabric portion 52. Between side or edge 44, mesh 50, and side or edge 46, fabric portion 52 is single layered. Apex portions 54 are double layered and include stitching about magnetic disk assemblies 58 such that movement of the magnetic disk assemblies 58 is minimized. Sheeting 14 is single layered.

In the state shown in FIG. 1B, apex portions 54 of opposing flaps are adjacent to each other and at least partially overlap each other. When in the form or state shown in FIG. 3, the operational form, apex portions 54 of side by side, adjacent flaps 36 and 40 on one side of the canopy 10 are adjacent to each other and may be positioned to at least partially overlap each other. When in the form or state shown in FIG. 3, the operational form, apex portions 54 of side by side, adjacent flaps 38 and 42 on the other side of the canopy 10 are adjacent to each other and may be positioned to at least partially overlap each other.

A closed pocket 56 is formed at each of the apex portions 54. In flap 36, closed pocket 56 is formed immediately at the apex portion 54 such that closed pocket 56 shares an edge with edge or side 48 and edge or side 46. In flap 40, closed pocket 56 shares an edge with edge or side 48 and is spaced from edge or side 46. This arrangement provides an overlap of flap 36 upon flap 40 in the operational position of FIG. 3 because each of the pockets 56 houses a magnetic disk assembly 58, with the magnetic disk assembly 58 of flap 36 engaging the magnetic disk assembly 58 of flap 40. Magnetic disk assembly 58 includes an open face 140 with a relatively strong magnetic pull or engagement and a closed face with a relatively weak magnetic pull or engagement, as discussed with respect to FIGS. 12B, 12C, 12D, 12E, and 12F. As to the overlapping flaps 36 and 40 shown in FIG. 3, the open faces 140 of the respective disk assemblies 58 are oriented toward each other and the closed faces 142 are oriented away from each other. If desired, magnetic disk assembly 58 may be either a permanent magnet or a material that is attracted to a magnet. For example, closed pocket 56 of flap 36 may house a disk or piece that is a permanent magnet, while closed pocket 56 of the adjacent same side flap 40 may house a disk or piece that is attracted to a magnet.

Figure 3:
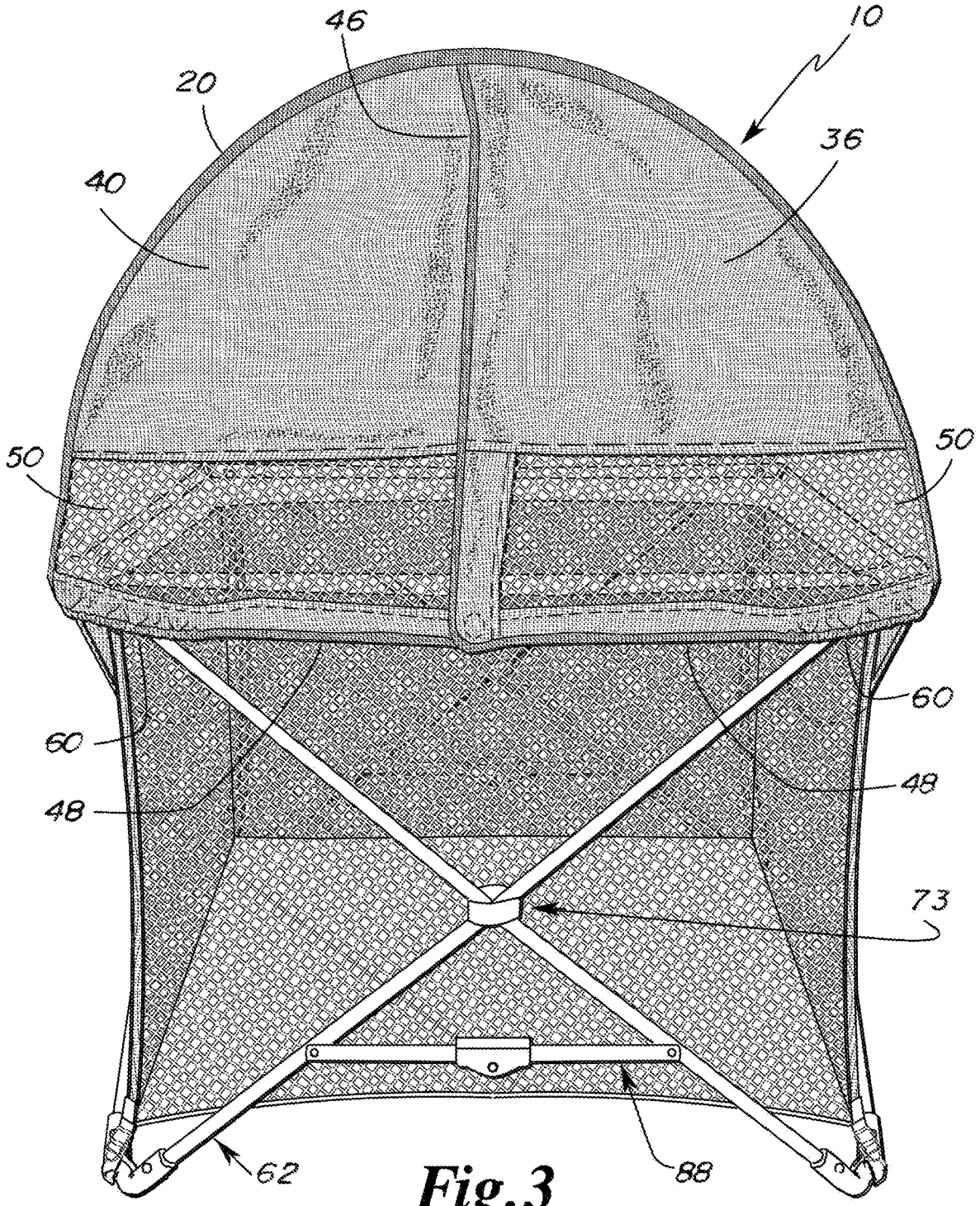
FIG. 3 is a perspective view of the front of the canopy of FIG. 1A engaged with a playyard generally having the shape of a cube.

When in the operational form, as shown in FIG. 3, the open faces 140 of the respective magnetic disk assemblies 58 are magnetically engaged to each other so as to keep flaps 36, 40 (or flaps 38, 42) in a closed position where the edges 46 of flaps 36, 40 (or flaps 38, 42) extend adjacent to each other but with the edge 46 of flap 36 positioned to overlap the edge 46 of flap 40. Pocket 56 is a closed pocket. There is no opening in closed pocket 56 for inserting or removing magnetic disk assembly 58. Edge 46 of flap 36 is engaged to envelope 20 at a location where such edge 46 of flap 36 extends over edge 46 of flap 40 such that, with closed pocket 56 of flap 40 being offset from edge 46 of flap 40, edges 46 of the respective flaps 36, 40 run generally parallel to each other when the canopy 10 is in the operational position shown in FIG. 3.

Flap 42 includes a closed pocket 56 that is disposed at the location of closed pocket 56 of flap 36. That is, closed pocket 56 is disposed immediately at the apex portion 54 of flap 42 such that closed pocket 56 of flap 42 shares edges with edges 46 and 48 of flap 42. Likewise, flap 38 includes a closed pocket 56 that is disposed at the location of closed pocket 56 of flap 40. That is, closed pocket 56 of flap 38 is offset or spaced from edge 46 of flap 38 and shares an edge with edge 48 of flap 38. Still further, to provide for generally parallel edges for edges 46 of flaps 38, 42 when the canopy 10 is in the operational form of FIG. 3, edge 46 of flap 42 overrides edge 46 of flap 38 where such edges engage envelope 20.

It should be noted that, in the flat form or state shown in FIG. 1B, a) magnetic disk assembly 58 (shown by circular dashed lines in closed pockets 56 in FIG. 1B) of flap 36 magnetically engages magnetic disk assembly 58 of flap 38, and b) magnetic disk assembly 58 of flap 40 magnetically engages magnetic disk assembly 58 of flap 42. With such an engagement flaps 36, 38, 40, and 42 stay flat against sheeting 14. Such is the state in which the flaps 36, 38, 40, 42 remain for the folding steps of FIGS. 10A, 10B, 10C, 10D, 10E, and 10F.

All four magnetic disk assemblies 58 include a permanent magnet or disk 138. If desired, one magnetic disk assembly 58 of flaps 36, 40 may include a permanent magnet while the other magnetic disk assembly 58 of flaps 36, 40 may include a material, such as a ferrous metal such as a cast or wrought iron, carbon steel, alloy steel, or stainless steel, that is attracted to a magnet. Likewise, one magnetic disk assembly 58 of flaps 38, 42 may include a permanent magnet while the other magnetic disk assembly 58 of flaps 38, 42 may include a material, such as a ferrous metal such as a cast or wrought iron, carbon steel, alloy steel, or stainless steel, that is attracted to a magnet. Magnetic disk assembly 58 is formed in the shape of a disk as shown in FIGS. 12B, 12C, and 12F. Instead of or in combination with the quick connect magnetic disk assembly 58, the flaps 36, 38, 40, 42 may be engaged to each other with one or more other quick connectors such as buttons, snaps, zippers, or connectors having macroscopic hook and loop material such as Velcro®.

Each of the flaps 36, 38, 40, 42 further includes an elastic portion 60. Elastic portion 60 runs in a portion of side or edge 48. Elastic portion 60 extends from the side of the canopy 10 so as to extend from the endless envelope 20. Elastic portion 60 is a strip or piece of elastic material that is stitched in side or edge 48 so as to be one-piece with a segment of side or edge 48.

Figure 2:
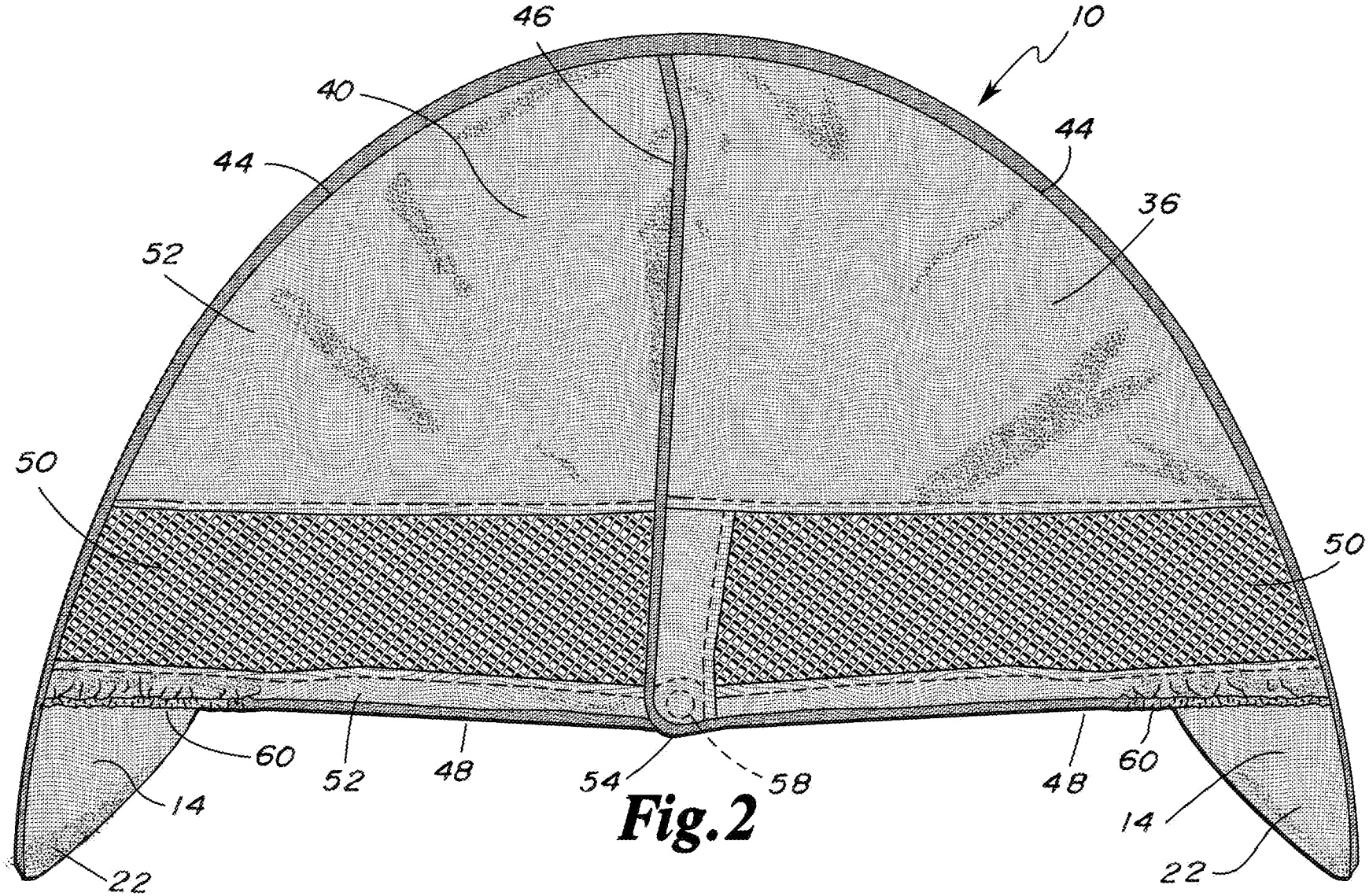
FIG. 2 is a perspective view of the front of the canopy of FIG. 1A, where the canopy is in a stand alone state, where front flaps are engaged with each other, and where rear flaps are engaged with each other.

FIG. 2 shows the canopy 10 in a stand alone operational position. Here the magnetic engagement between magnetic disk assemblies 58 on one side of the canopy 10 are sufficiently strong to overcome the resilient bias of the resilient element 16 that would otherwise return the canopy 10 to the at rest position shown in FIGS. 1A and 1B. With the engagement of all four magnetic disk assemblies 58, such that flaps 36 and 40 are engaged on one side of the canopy 10 and such that flaps 38 and 42 are engaged on the other side of the canopy 10, there is more than sufficient strength to overcome the resilient bias of the resilient element 16 that would otherwise return the canopy 10 to the at rest position shown in FIGS. 1A and 1B.

In the state or form of FIGS. 2 and 3, the horizontal edges or sides 48 of side by side flaps 36 and 40 (or flaps 38 and 42) are disposed generally horizontally and are generally aligned with each other in a general straight line. Each of the sides or edges 46, 48 of flaps 36 and 40 (or flaps 38 and 42) generally defines a straight line.

In the state or form of FIGS. 2 and 3, the vertical sides or edges 46 of side by side flaps 36 and 40 (or flaps 38 and 42) are disposed generally vertically and extend generally parallel to each other.

In the state or form of FIGS. 2 and 3, the vertical sides or edges 46 of side by side flaps 36 and 40 (or flaps 38 and 42) extend adjacent to each other for their entire lengths.

In the state or form of FIGS. 2 and 3, one vertical side or edge 46 of side by side flaps 36 and 40 (or flaps 38 and 42) overlaps the other vertical side or edge 46 of side by side flaps 36 and 40 (or flaps 38 and 42). In such state or form of FIGS. 2 and 3, vertical side or edge 46 of flap 36 frontally overlaps vertical side or edge 46 of flap 40 such that a portion of flap 36 hides a portion of flap 40. If desired, vertical side or edge 46 of flap 40 may frontally overlap vertical side or edge 46 of flap 36. The same overlapping may take place with the pair of flaps 38 and 42.

FIG. 2 shows that ends 22 of sheeting 14 are spaced apart in the stand alone operational form or state. Ends 22 are closer together in the stand alone operational state of FIG. 2 than in the at rest state or form shown in FIGS. 1A and 1B.

FIG. 2 shows that the sheeting 14 forms a U-shape where no portion of sheeting 14 extends in a vertical plane. Except for the peak of the U-shape of FIG. 2 of the sheeting 14 where a tangent that intersects such peak is a horizontal tangent, all other portions of sheeting 14 extend obliquely relative to a horizontal or vertical axis. Such is in contrast to FIG. 3 where ends 22 or portions thereof extend generally in a vertical plane.

FIG. 2 shows front flaps 36, 40 engaging each other, and rear flaps 38, 42 engage each other in a like fashion in the rear of canopy 10 of FIG. 2. Such sets of flaps engage each other with the magnetic disk assemblies 58. A horizontal plane is generally defined by the horizontal or lower edge or sides 48 of each of the front flaps 36, 40 and rear flaps 38, 42.

Figure 7A:
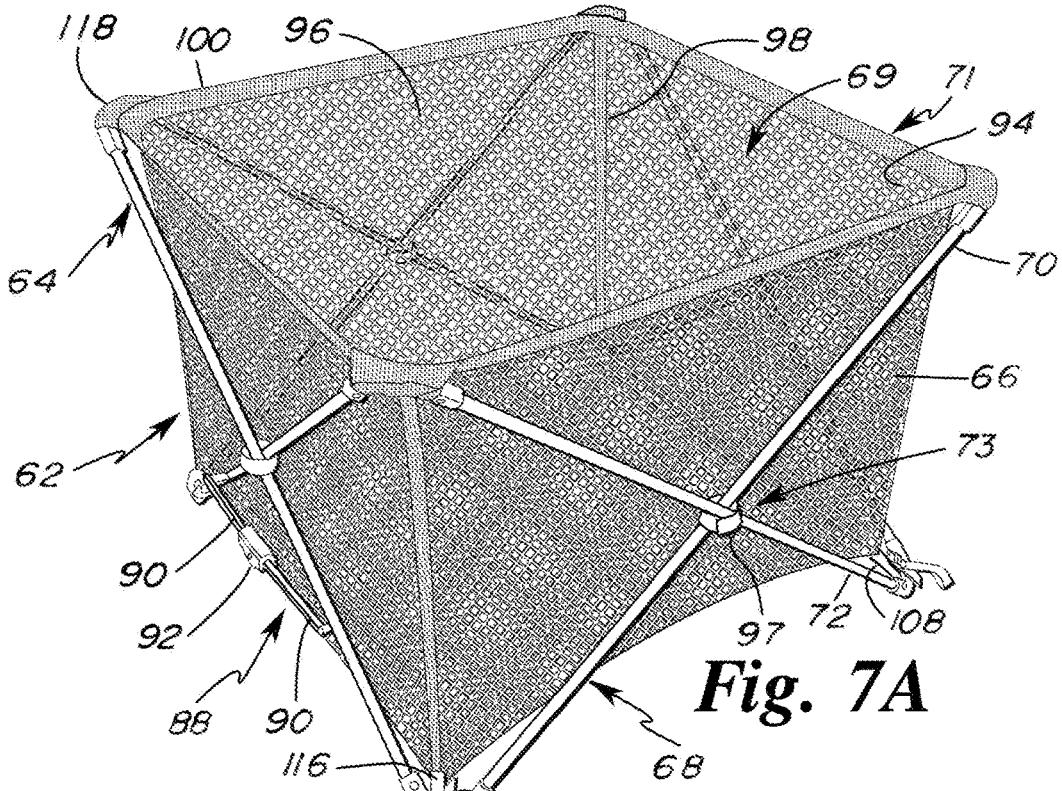
FIG. 7A is a perspective view of the playyard of the canopy and playyard combination of FIG. 3, where the playyard is right side up.
Figure 7B:
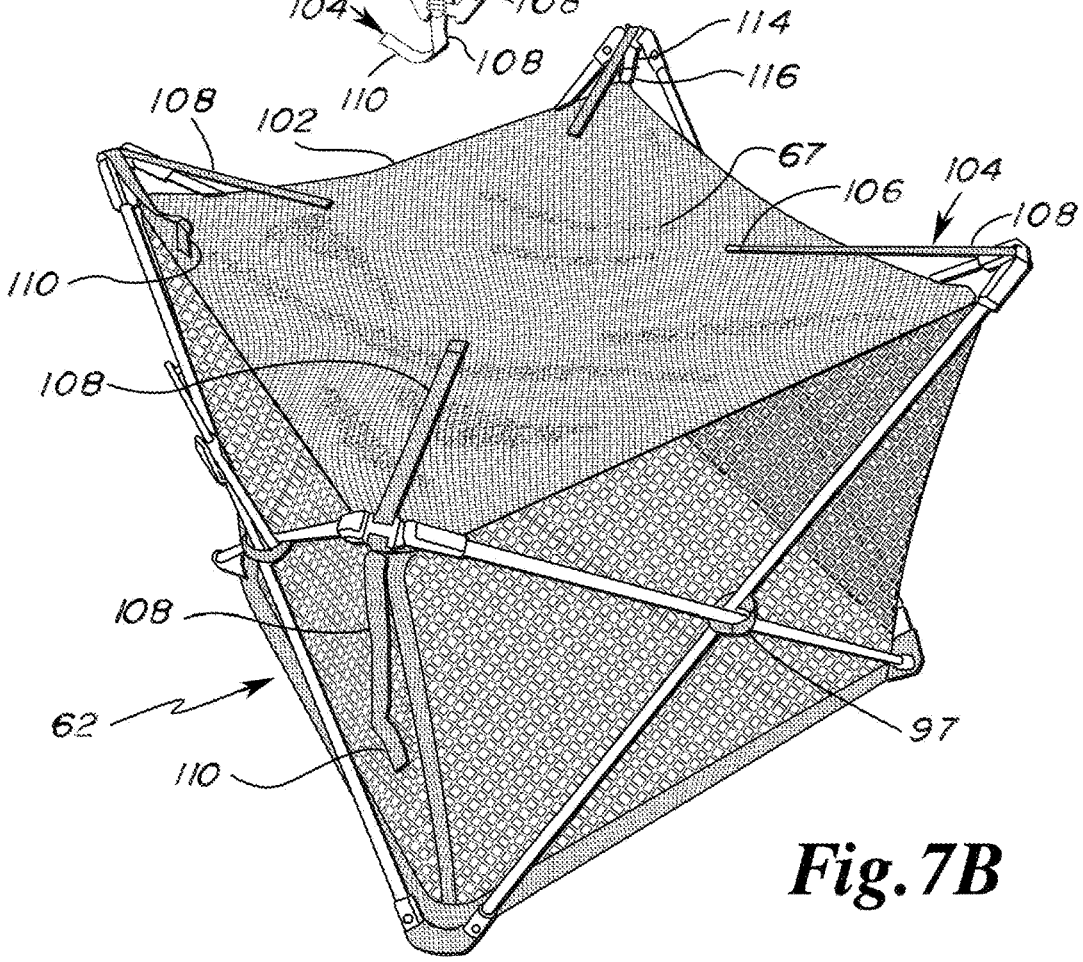
FIG. 7B is a perspective view of the playyard of the canopy and playyard combination of FIG. 3, where the playyard is upside down.

FIG. 3 shows the canopy 10 engaged on a playyard 62. A stand alone playyard 62 is shown in FIGS. 7A and 7B. As to playyard 62, the Flannery et al. U.S. Pat. No. 10,194,755 B1 issued Feb. 5, 2019 and entitled Playyard is hereby incorporated by reference in its entirety.

As shown in FIGS. 7A and 7B, playyard 62 includes a scissoring, exterior, endless, folding frame 64, an endless sidewall 66, and a floor 67. Floor 67 and endless sidewall 66 define a flexible pen 69 with an open top 71.

Frame 64 is a scissoring folding frame. Frame 64 includes four folding scissoring sections 68. Each of the sections 68 includes a pair of tubular frame members 70, 72 interconnected at an intermediate junction 73 by a pin connector 74 (shown in FIG. 8B). Frame member 70 is adjacent to and spaced from sidewall 66 with no other frame members, including frame member 72, between such frame member 70 and the sidewall 66. The other of the frame members, namely frame member 72, is adjacent to and spaced from the sidewall 66 with frame member 70 being between such frame member 72 and the sidewall 66. Frame section 68 can scissor out to the expanded "X" form shown in FIGS. 7A and 7B and can scissor in to the retracted "X" form shown in FIG. 11.

Figure 8A:
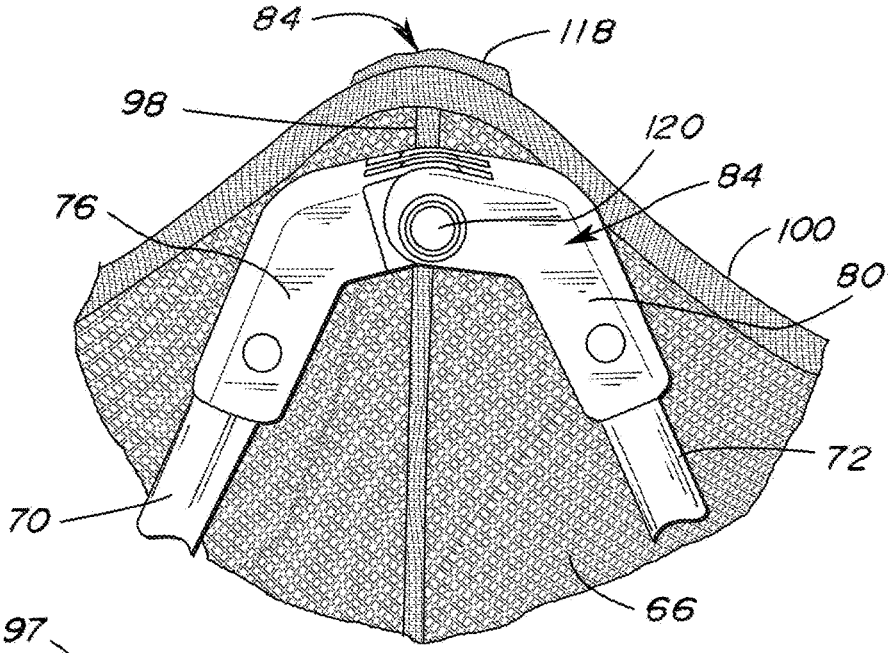
FIG. 8A is a perspective detailed view the upper pivot connection or upper junction of the frame of the playyard of the canopy and playyard combination of FIG. 3.
Figure 8B:
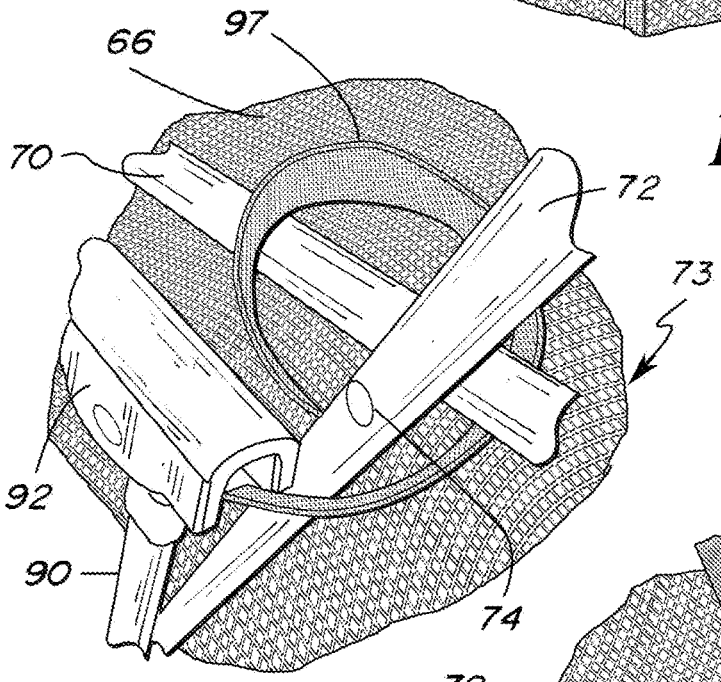
FIG. 8B is a perspective detailed view of the intermediate pivot connection or intermediate junction of the frame of the playyard of the canopy and playyard combination of FIG. 3.
Figure 8C:
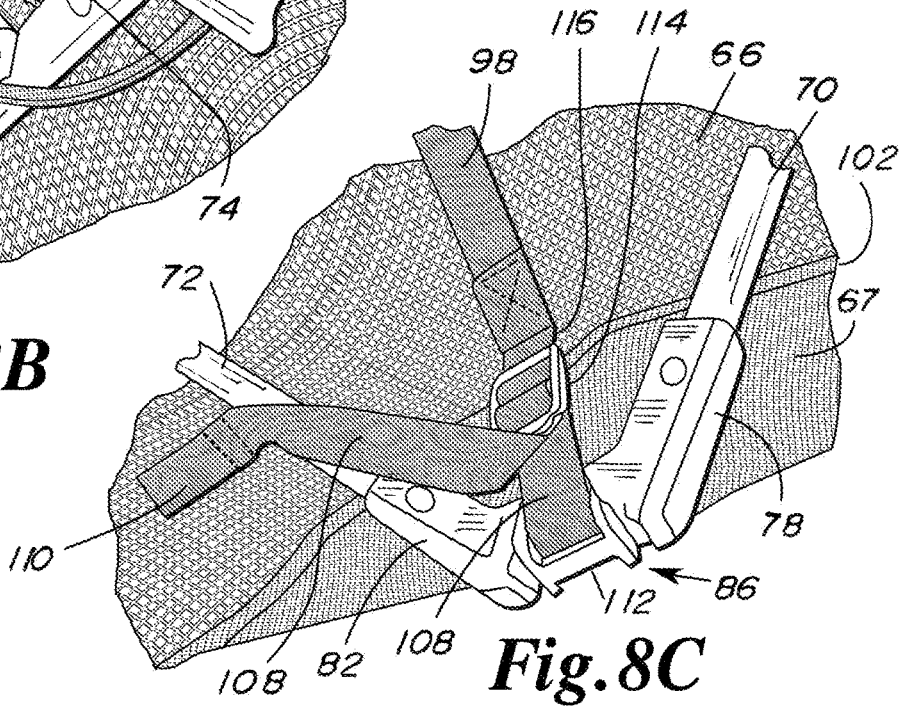
FIG. 8C is a perspective detailed view of the lower pivot connection or lower junction of the frame of the playyard of the canopy and playyard combination of FIG. 3.

Frame member 70 includes an upper end 76 (shown in FIG. 8A) and a lower end 78 (shown in FIG. 8C). Frame member 72 includes an upper end 80 (shown in FIG. 8A) and a lower end 82 (shown in FIG. 8C). Upper end 76 of frame member 70 of one frame section 68 is pivotally engaged at an upper junction 84 to upper end 80 of frame member 72 of an adjacent frame section 68. Lower end 78 of frame member 70 of one frame section 68 is pivotally engaged at a lower junction 86 to lower end 82 of frame member 72 of an adjacent frame section 68.

Endless frame 64 includes a pair of over-center lock apparatus 88 having frame members 90 with distal ends that pivotally engage frame members 70, 72 and with proximal ends that pivotally engage a center piece 92. When the center piece 92 of one over-center lock apparatus 88 is pushed down, such as with a foot, the endless frame 64 scissors out to a locked position such as shown in FIGS. 7A and 7B. When the center pieces 92 of each of the over-center apparatus 88 are pulled up, such as with a foot, the endless frame 64 scissors in to an unlocked position and can continue to scissor in to the compact folded in position shown in FIG. 11. The over-center lock apparatus 88 are engaged on opposite sides of the playyard 62 such that the over-center lock apparatus 88 are engaged on opposing folding sections 68.

When one over-center lock apparatus 88 is pushed down to the locked position, such prevents upper ends 76, 80 of its folding section 68 from pivoting relative to each other and also prevents lower ends 78, 82 of its folding section from pivoting relative to each other, which in turn prevents all of the remaining three upper junctions 84 and all of the remaining three lower junctions 86 from pivoting. To solidify this rigidifying lock that has extended throughout all four folding sections 68 singlehandedly by one over-center lock apparatus 88, the other over-center lock apparatus 88 may be pushed down to the locked position.

When both over-center lock apparatus 88 are pulled up to the unlocked position, such permits upper ends 76, 80 and lower ends 78, 82 throughout the endless frame 64 to pivot relative to each other. When one over-center lock apparatus 88 is in the locked position and the other over-center lock apparatus 88 is in the unlocked position, the endless frame 64 does not fold or pivot but instead remains in a locked state.

Endless sidewall 66 is flexible. Endless sidewall 66 may be formed of a fabric material. Endless sidewall 66 may be formed of a mesh material as indicated by reference number 94.

Endless sidewall 66 includes four sections 96 joined to each other by a vertically extending elongate strap like piece or strip 98 that is stitched or engaged vertically between adjacent sections 96. Opposing sidewall sections 96 are engaged to their respective intermediate junctions 73 by a strap 97. Strap 97 is flexible and includes macroscopic hooks on one side and macroscopic loops on the other side such that strap 97 can be wrapped about the intermediate junction 73 and engaged to itself so as to engage the sidewall section 96 to the frame 64 at a central portion of the sidewall section 96. Strap 97 is engaged, such as by stitching, to the central portion of the sidewall section 96. Strap 97 is a quick connector. Velcro® is a material that may provide the macroscopic hooks and macroscopic loops that releasably engage each other.

An upper peripheral reinforcing piece 100 of fabric material forms an upper perimeter to the endless sidewall 66. Reinforcing piece 100 is flexible.

Playyard floor 67 is engaged to endless sidewall 66 on each of the four sides of the floor 67 by an endless transition strip 102 (shown in FIG. 8C) stitched or otherwise engaged to and between the endless sidewall 66 and the floor 67. Vertical strip or piece 98 runs to and between upper horizontal strip or piece 100 and lower horizontal strip or piece 102.

Floor 67 defines a closed bottom to the playyard 62. Floor 67 is opposite of an open top 71 of the playyard 62. Floor 67 defines a square. Upper horizontal strip or piece 100 defines a square. Lower horizontal strip or piece 102 defines a square. The length of vertical strip or piece 98 is generally about the length of each of the four segments of each of the upper horizontal strip or piece 100 and of each of the four segments of each of the lower horizontal strip or piece 102 such that playyard 62 generally defines a cube.

Floor 67 is flexible. Floor 67 is formed of a fabric or fabric like material. Floor 67 is formed of a non-see-through material. Floor 67 may be formed of a water-tight or a water-proof material. Floor 67 may be formed of a material having pores or spaces that keep out water or moisture in a liquid form but that permit water or moisture in a gas form to pass therethrough. Floor 67 may be formed of a material having pores or spaces that permit water or moisture in a liquid or gas form to pass therethrough. Floor 67 may be formed of a material having pores or spaces that do not permit the passage of either water or moisture in a liquid or gas form.

Playyard 62 further includes a radially extending and floor pulling or floor tightening strap 104 shown in FIGS. 7A and 7B. Strap 104 includes a distal end or distal end portion 106. Distal end or distal end portion 106 is stitched or otherwise engaged, such as by adhesive, to floor 67. Strap 104 confronts the bottom face of floor 67. Strap 104 further includes a remainder strap portion made up of an intermediate strap portion 108 and a proximal end or proximal end portion 110, both of which portions are free of the floor 67. Proximal end portion 110 is fed through a slotted piece 112 that is pivotally engaged to the bottom of the lower junction 86. Proximal end portion 110 is then fed up to a buckle 114, through the buckle 114, and out of the buckle 114. Buckle 114 engages a flexible strap 116 that is in turn engaged, such as by stitching, to vertical strip 98 at a location adjacent to the junction between lower horizontal strip 102 and vertical strip 98. Horizontal strip 102 serves as a junction between floor 67 and endless sidewall 66. There is a three way junction where floor 67, horizontal strip 102 and vertical strip 98 intersect and it is adjacent to this three way junction on the vertical strip 98 where flexible strap 116 is engaged. When a user pulls on the proximal end portion 110 and pulls it outwardly, the intermediate strap portion 108 is relatively shortened such that the distal end portion 106 pulls outwardly on the floor 67, such that the distance between the three way junction and a center portion of the floor 67 is decreased such that the floor 67 is tightened relative to the endless sidewall 66. Strap 104 pulls the floor 67 taut or relatively tight when the playyard 62 is folded out from the compact form to the open form by engaging an interior portion of the floor 67 relative to a peripheral portion of the floor 67.

Endless sidewall 66 and its sidewall sections 96 are also pulled taut or relatively tight by the upper junctions 84 engaging flexible fabric ears 118 that extend from the upper peripheral strip or piece 100. Flexible fabric ears 118 extend from the four corners of the endless sidewall 66. An ear 118 extends from such a corner, then extends about the top of junction 84, then extends about the front of the junction 84, then extends about the bottom of the junction 84, and then extends to the rear of the junction 84 where it is engaged to the junction 84 by snaps, with a snap half portion being engaged to the rear of junction 84 and with a snap half portion being engaged to a distal end of the ear 118.

Figure 11:
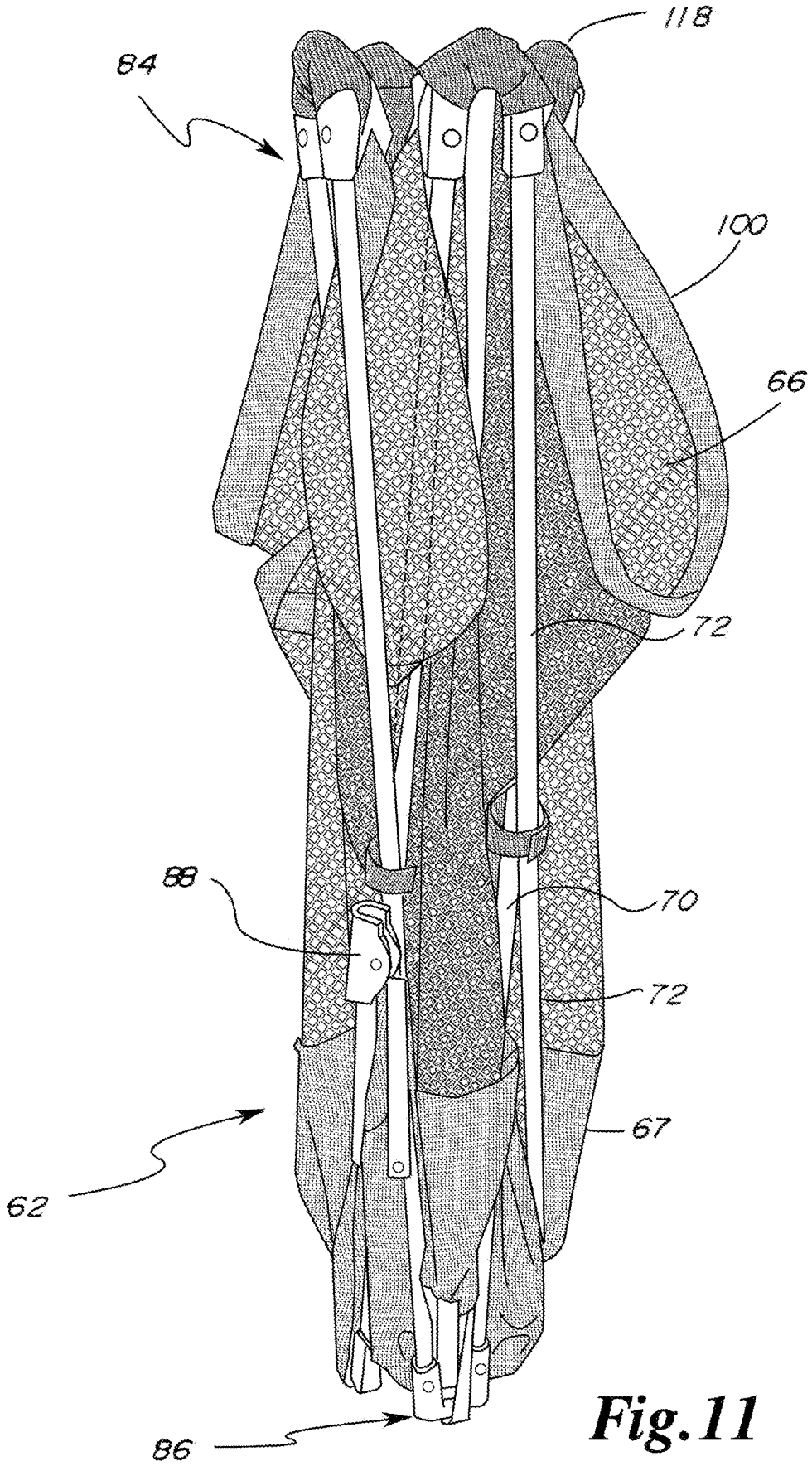
FIG. 11 is a perspective view of the playyard of the canopy and playyard combination of FIG. 1, where the playyard is in a folded, scissored in, and compact state.

In operation, to fold out the playyard 62 from the compact position shown in FIG. 11, the frame 64 is folded out, preferably to a position just short of being fully folded out. Then the upper junctions 84 are fixed relative to the endless sidewall 66 by engaging the ears 118 to the upper junctions 84, although the ears 118 can remain engaged to the upper junctions 84 when the playyard 62 is in the compact state of FIG. 11. Then the over-center lock apparatus 88 may be pushed down to a locked position to fully fold the frame 62 out. Then it may be desirable to adjust strap 104, using the buckle 114, to fix the floor 67 to the desired tightness, though it may not be necessary to adjust strap 104. When the frame 64 is fully opened and the locks 88 locked, sidewall sections 96 are generally planar and flat with no folds and the floor 67 is generally planar and flat with no folds.

To collapse the playyard 62 from the open position shown in FIGS. 7A and 7B to the closed or compact position shown in FIG. 11, the lock apparatus 88 are pulled up, thereby permitting the upper and lower junctions 84, 86 to pivot. Then the frame 62 is folded further to place the upper junctions 84 adjacent to each other and to place the lower junctions 86 adjacent to each other. During this step of folding the playyard 62 from the open form to the closed or compact form, straps 104 may or may not be loosened.

During the steps of folding out and folding in the playyard 62, the intermediate portion 108 of strap 104 slides back and forth in slotted piece 112.

Figure 4:
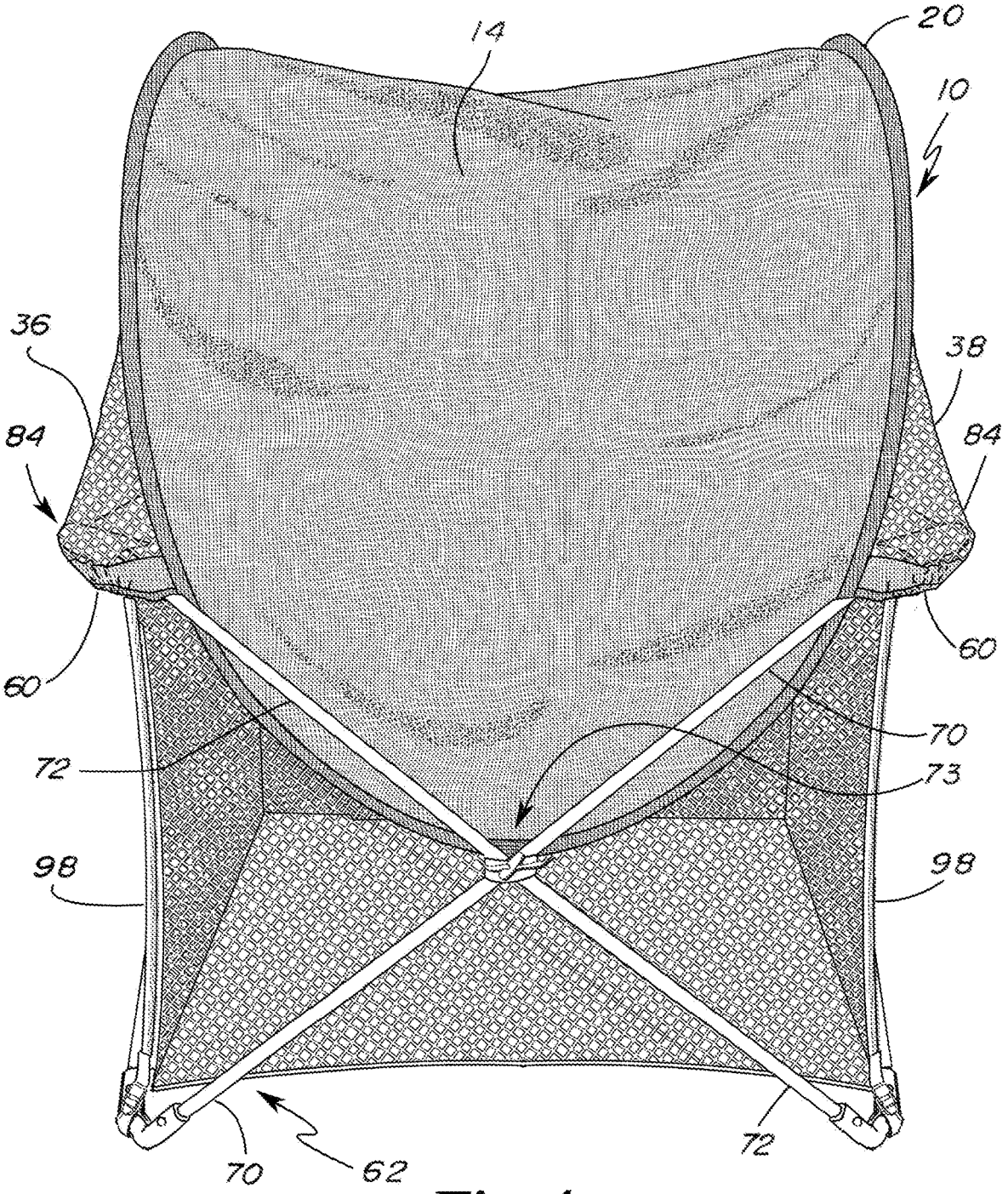
FIG. 4 is a perspective view of the side of the canopy and playyard combination of FIG. 3.

FIGS. 3 and 4 show canopy 10 on cube shaped playyard 62. Canopy 10 is resiliently bent into the U-shape shown in FIG. 3, then a first end 22 of the canopy 10 is tucked between support members 70, 72 and endless sidewall 66 of the flexible pen 69 on one side of the cube shaped playyard 62, and then a second end 22 of the canopy 10 is tucked between support members 70, 72 and endless sidewall 66 of the flexible pen 69 on the other side of the cube shaped playyard 62.

To further engage the canopy 10 to the cube shaped playyard 62, toggle closure 25 is engaged. In other words, the loop 30 of one end of the canopy 10 is stretched out over the intermediate junction 73 one way, the peg or dowel 26 via the resilient strip 28 of the same end of the canopy 10 is stretched out over the intermediate junction 73 from the other way, then the peg 26 is fed through the loop 30, and then such assembly is released such that the peg 26 and loop 30 elastically catch each other about the intermediate junction of the support members 70, 72 so as to engage one end 22 of the canopy 10 to the cube shaped playyard 62. The same operation is carried out on the opposing side of the cube shaped playyard 62 with the second toggle closure 25, i.e., the second peg 26 and second loop 30 of the other end 22 of the canopy 10.

To still further engage the canopy 10 to the cube shaped playyard 62, the elastic portions 60 of sides or edges 48 are stretched so as to tuck under the upper junctions 84 of the endless frame 64. Sides or edges 48 of the flaps 36, 38, 40, 42 are disposed at a lower elevation than is endless horizontal strip 100 of playyard 62.

To yet further engage the canopy 10 to the cube shaped playyard 62, the apex portions 54 of adjacent flaps 36, 40 on one side of the canopy 10 are engaged to each other through the embedded magnetic disk assemblies 58 (one or both of which may be magnetic).

To yet further still engage the canopy 10 to the cube shaped playyard 62, the apex portions 54 of adjacent flaps 38, 42 on the other side of the canopy 10 are engaged to each other through the embedded magnetic disk assemblies 58 (one or more of which may be magnetic).

As shown in FIG. 3, a portion of each of the ends 22 of the canopy 10 defines a vertical plane. This is in contrast to the form shown in FIG. 2 where all tangents to the U-shaped of FIG. 2 are oblique except for a tangent intersecting the peak of the U-shaped of FIG. 2. In other words, opposing portions of canopy ends 22 extend parallel to each other in the state shown in FIGS. 3 and 4 and further extend parallel to the sidewall sections 96 that the canopy ends 22 confront, whereas in the state shown in FIG. 2 the canopy ends 22 extend obliquely relative to each other and are not parallel.

FIG. 3 shows that horizontal sides or edges 48 of adjacent flaps 36, 40 are generally aligned with each other in a straight line. The same is true with respect to adjacent flaps 38, 42 on the other side of the playyard-canopy combination.

FIG. 3 shows that vertical sides or edges 46 of flaps 36, 40 partially overlap each other because of the face to face engagement of the respective magnetic disk assemblies 58 (one or both of which is magnetic) and the offset of one of the pockets 54. The same is true with respect to adjacent flaps 38, 42 on the other side of the playyard-canopy combination.

FIGS. 3 and 4 shows that the canopy 10 extends about an entirety of an upper portion of endless sidewall 66 so as to extend about an entirety of the open top 71 of the cube-shaped playyard 62. As to the six segments that provide such an entire wrap around feature, flaps 36, 38, 40, 42 provide four of these segments and sheeting 14 provides the remaining two segments. As indicated above, sides or edges 48 of flaps 36, 38, 40, 42 extend at a lower elevation than the open top 71 of the playyard 62.

FIG. 3 shows that the vertical edges or sides 46 of flaps 36, 40 generally align with the intermediate junction 73 of the frame 64 of the cube shaped playyard 62. In other words, intermediate junction 73 on one side of the playyard 62 generally lies on a straight line defined by one or more vertical sides or edges 46 of flaps 36, 40 of the associated side of the canopy 10. The same relationship holds on the other side of the playyard 62 that is associated with its respective side of the canopy 10.

FIG. 4 shows that the ends 22 of the canopy 10 are stopped from sliding downwardly by straps 97. Strap 97 is engaged, such as by stitching, to its respective sidewall section 96 and then extends from such sidewall section 96 to engage the intermediate junction 73.

Side to side movement of the canopy 10 is minimized by opposing elastic portions 60 tugging opposite ways upon the sheeting 14 and its resilient element 16.

Upward movement of the canopy 10 is minimized by the engagement of the first and second toggle closures 25, i.e., the first peg 26 and first loop 30 about the intermediate junction 73 on one side of the cube shaped playyard 62 and the engagement of the second peg 26 and second loop 30 about the intermediate junction 73 on the other side of the cube shaped playyard 62.

Outward and upward movement of the sheeting 14 and resilient element 16 under the bias of the resilient element 16 to resiliently return to the generally flat state shown in FIGS. 1A and 1B, is prevented by the support members 70, 72 that are arranged in transverse or crossing fashion as shown in FIG. 4. In other words, the crossing support members 70, 72 prevent the canopy 10 from bending from the U-shaped state shown in FIGS. 3 and 4 to the generally flat state shown in FIGS. 1A and 1B. In still other words, the crossing support members 70, 72 hold the canopy 10 in the tensioned U-shaped state shown in FIGS. 3 and 4.

Figure 5A:
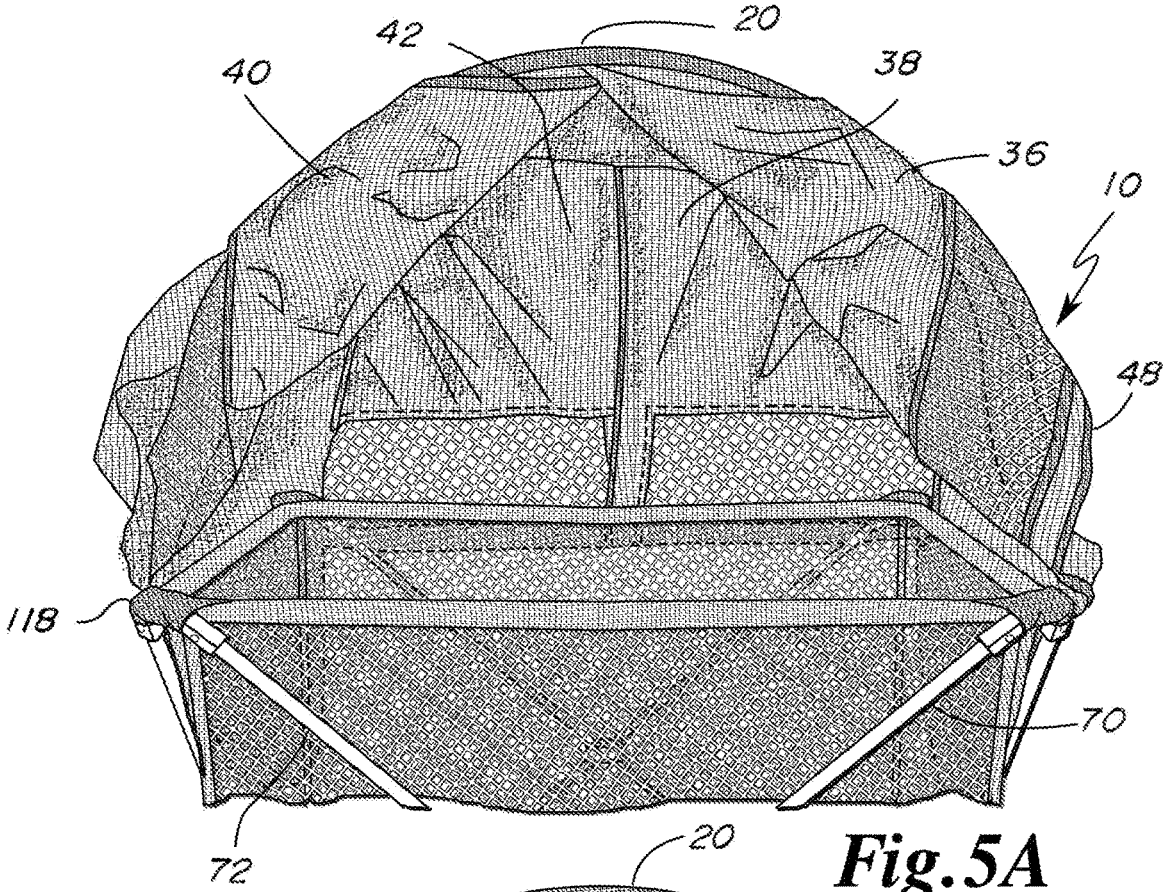
FIG. 5A is a front, partial view of the canopy and playyard combination of FIG. 3, where the front flaps are disengaged from each other and laid back, and where the rear flaps are engaged with each other.

FIG. 5A shows that one set of flaps 36, 40 may be opened and that the other set of flaps 38, 42 may remain closed. When flaps 36, 40 are open, the apex portions 54 having the magnetic disk assemblies 58 embedded therein may reside on sheeting 14 on the top of the canopy 10. The weight or mass of magnetic disk assembly 58 holds its respective flap 36, 40 in the open position. In the open position, elastic portion 60 may be disengaged from its respective upper junction 84. In another open position, elastic portions 60 of flaps 36, 40 may remain engaged underneath upper junctions 84, and apex portions 54 of flaps 36, 40 may be disengaged from each other such that flaps 36, 40 depend or hang down without the magnetic disk assemblies 58 (one or more of which are magnetic) engaging each other, but with apex portions 54 being adjacent to each other.

Figure 5B:
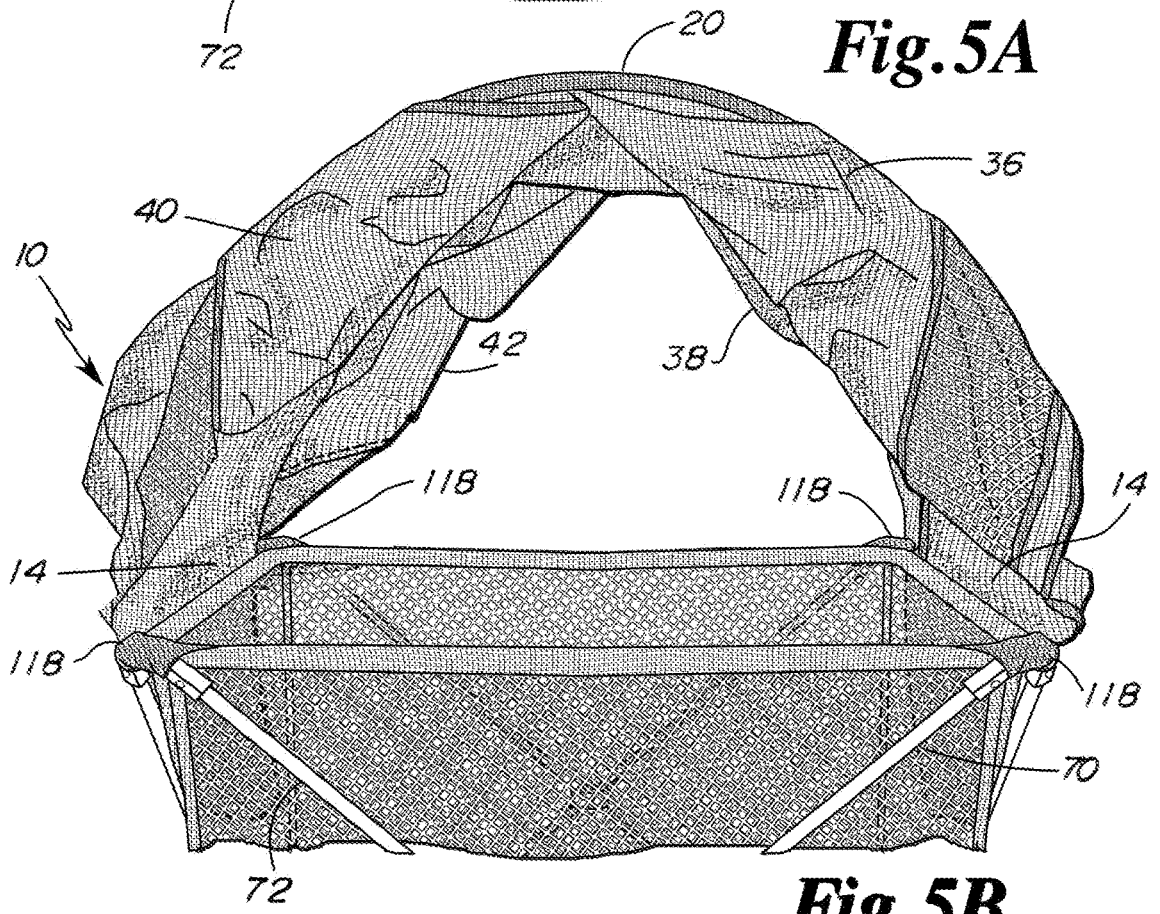
FIG. 5B is a front, partial view of the canopy and playyard combination of FIG. 3, where the front flaps are disengaged from each other and laid back, and where the rear flaps are disengaged from each other and laid back.

FIG. 5B shows that one set of flaps 36, 40 may be opened and that the other set of flaps 38, 42 may also be opened. When such sets of flaps are open as shown in FIG. 5B, all four apex portions 54 having the magnetic disk assemblies 58 embedded therein reside on sheeting 14 on the top of the canopy 10. The weight or mass of each of the magnetic disk assemblies 58 holds the flaps 36, 38, 40, 42 in the open position. In the state shown in FIG. 5B, all four elastic portions 60 are disengaged from their respective upper junctions 84. In another open position, elastic portions of flaps 38, 42 may remain engaged underneath upper junctions 84, and apex portions 54 of flaps 38, 42 may be disengaged from each other such that flaps 38, 42 depend or hang down without the magnetic disk assemblies 58 (one or more of which are magnetic) engaging each other, but with apex portions 54 being adjacent to each other. More air is circulated into the playyard and canopy combination shown in FIG. 5B than is circulated into the playyard and canopy combination of FIG. 5A.

Figure 6:
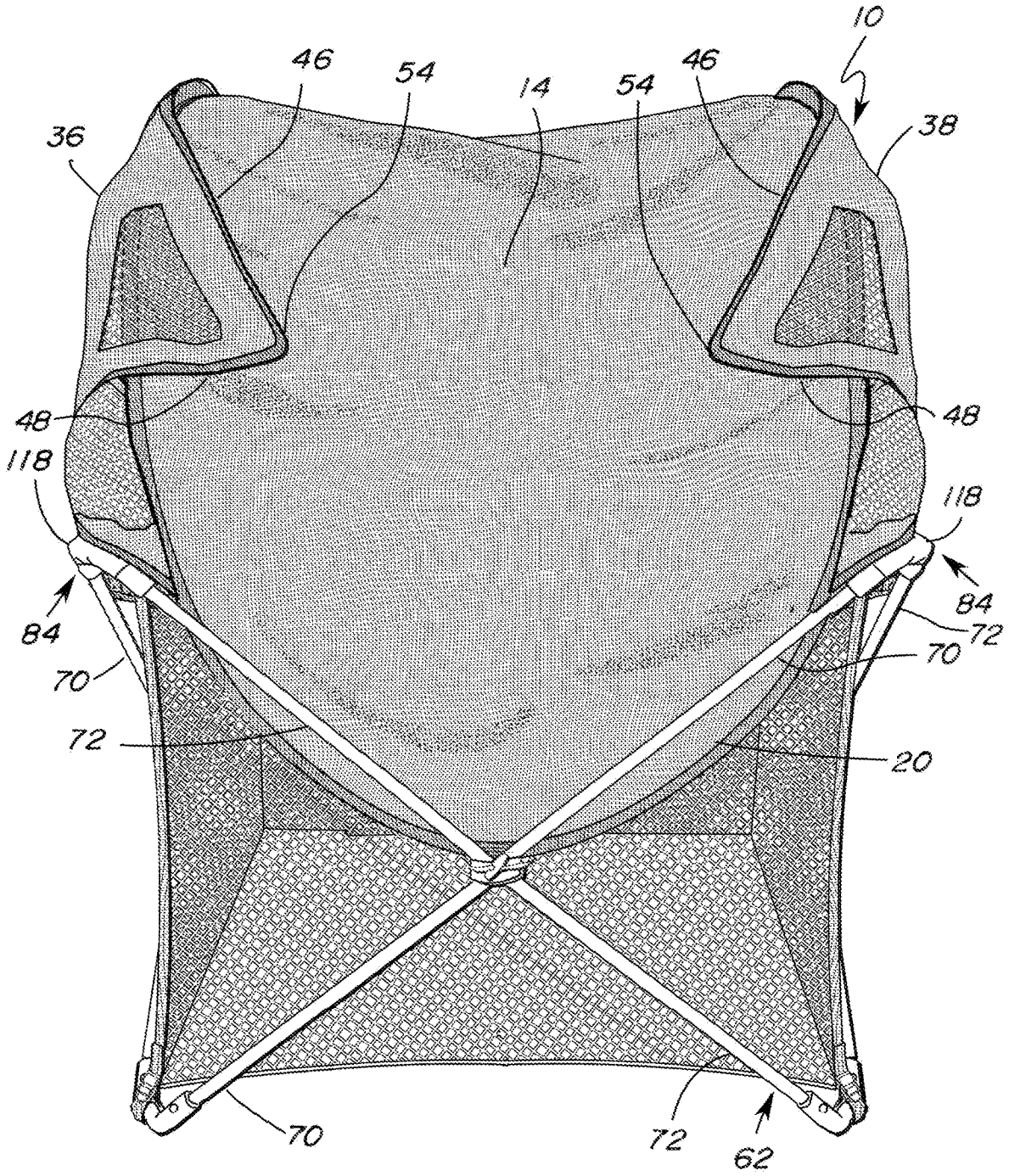
FIG. 6 is a side view of the canopy and playyard combination of FIG. 3, where the front flaps are disengaged from each other and laid back, and where the rear flaps are disengaged from each other and laid back.

FIG. 6 is a side view of the playyard and canopy combination of FIG. 5B. FIG. 6 shows the apex portions 54 having the magnetic disk assemblies 58 embedded therein of flaps 36 and 38 residing on the sheeting 14 on the top of the canopy 10. FIG. 6 shows the elastic portions 60 disengaged from the upper junctions 84. A view from the opposite side is identical to FIG. 6 but with apex portions 54 of flaps 40 and 42 residing on the sheeting 14 on the top of the canopy 10.

FIG. 8A shows a perspective view of an uncovered upper junction 84 in the foreground and an upper junction 84 in the background that is covered and engaged by ear 118. The upper junctions 84 shown in the foreground and background are disposed at opposite corners of the playyard 62. FIG. 8A further shows that upper junction 84 includes a pivot pin 120 connecting upper pivoting ends 76, 80.

FIG. 8B shows a perspective view of the intermediate junction 73. FIG. 8B shows pin connector 74 engaging frame members 70, 72. Strap 97 is stitched to sidewall 66 and then wraps around the intermediate junction 73 and engages itself.

FIG. 8C is a perspective view of the lower junction 86. The pivot connection that joins lower ends 78, 82 is not shown, but such is identical to the pivot connection 120 shown in FIG. 8A. FIG. 8C further shows the strip 102 that engages the floor 67 to the sidewall 66. FIG. 8C further shows the pivoting piece 112 having the slot that engages intermediate strap portion 108.

Figure 9A:
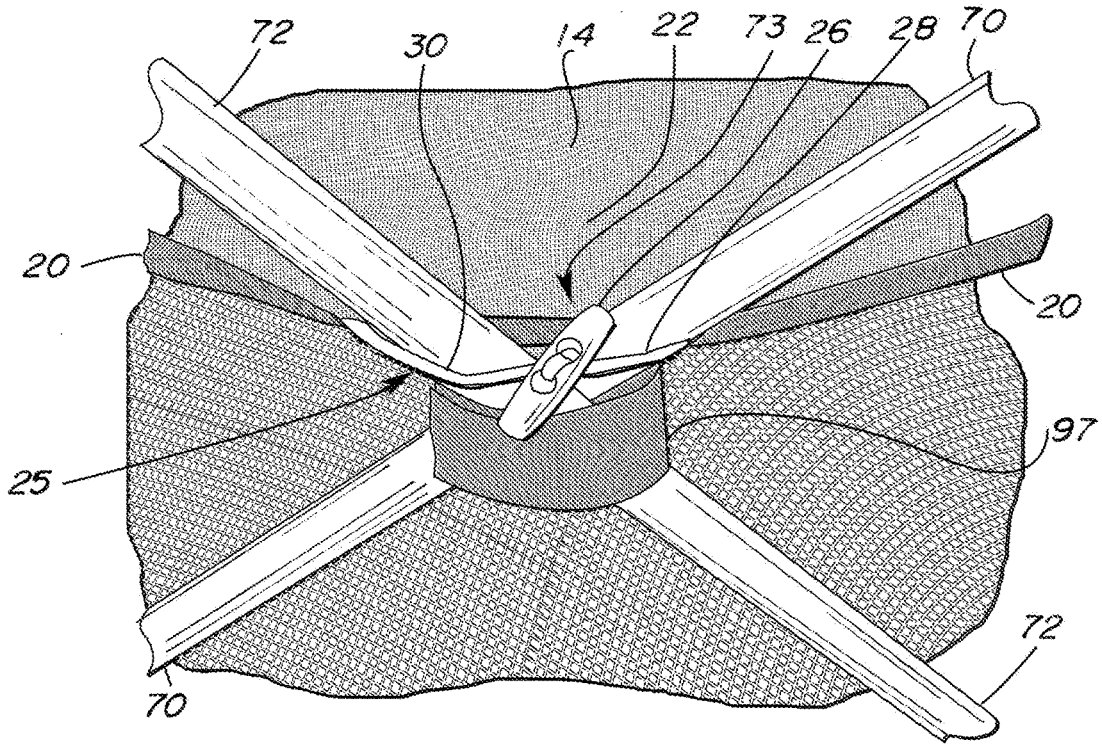
FIG. 9A is a perspective detailed view of the intermediate pivot connection or intermediate junction of the frame of the playyard of the canopy and playyard combination of FIG. 3, where a peg and loop combination engages one end of the canopy to the intermediate pivot connection.

FIG. 9A shows that the quick connect toggle closure 25 engaged to the intermediate junction by being stretched over the intermediate junction 73. FIG. 9A shows that strap 97 is engaged to the intermediate junction 73 by being wrapped about the intermediate junction 73 from where the strap 97 is stitched to mesh sidewall 66. It should be noted that the ends 22 of the canopy 10, or other portions of the canopy 10, may be secured to the intermediate junction 73 or to another portion of the playyard 62 such as the playyard frame 64 or the flexible endless sidewall 66 by other quick connect arrangements such as 1) macroscopic hook and loop connections or straps having such macroscopic hook and loop connections where an example of such a macroscopic hook and loop connection is Velcro®, 2) button connections or straps having such button connections, 3) snap connections or straps having such snap connections, and 4) buckle connections or straps having such buckle connections.

Figure 9B:
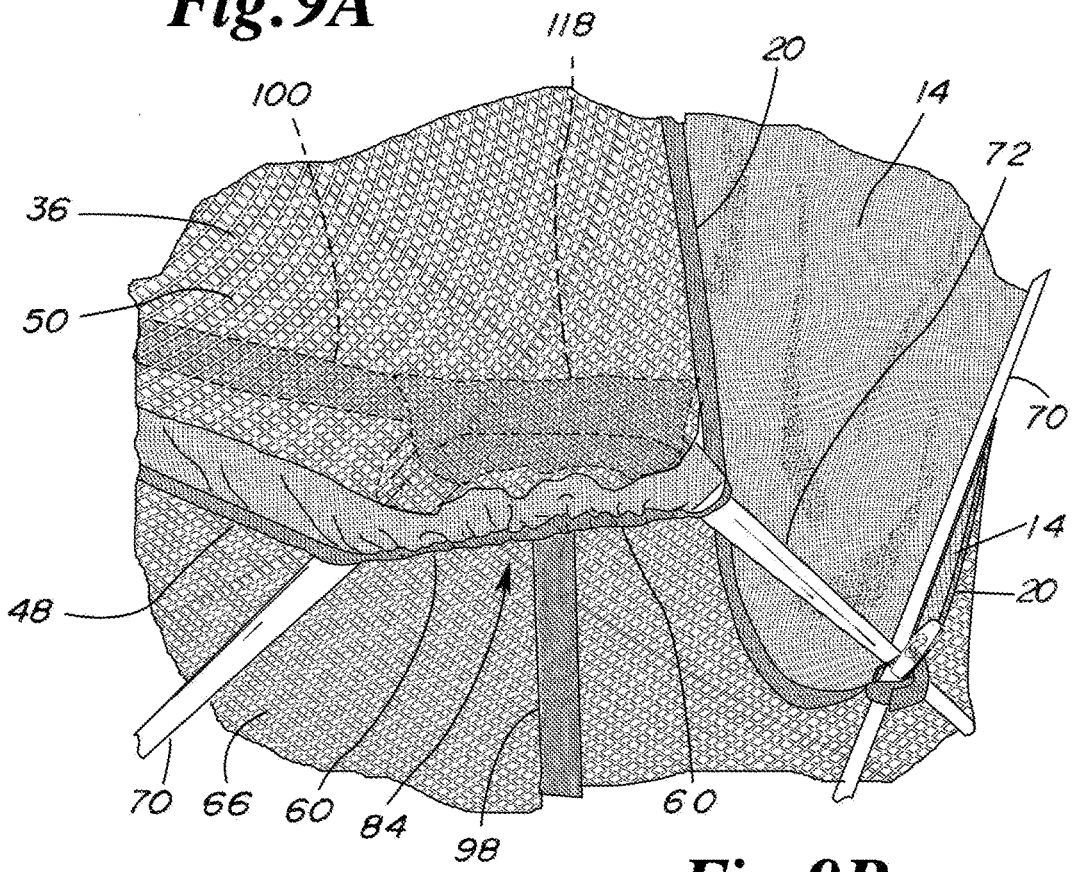
FIG. 9B is a perspective detailed view of the upper pivot connection or upper junction of the frame of the playyard of the canopy and playyard combination of FIG. 3, where an elastic portion of one of the flaps engages the canopy to the upper pivot connection.

FIG. 9B shows the elastic portion 60 engaging the upper junction 84 by being stretched under the upper junction 84. Ear 118 is shown through the mesh 50 of flap 36.

Figures 10A, 10B, 10C, 10D, 10E, 10F:
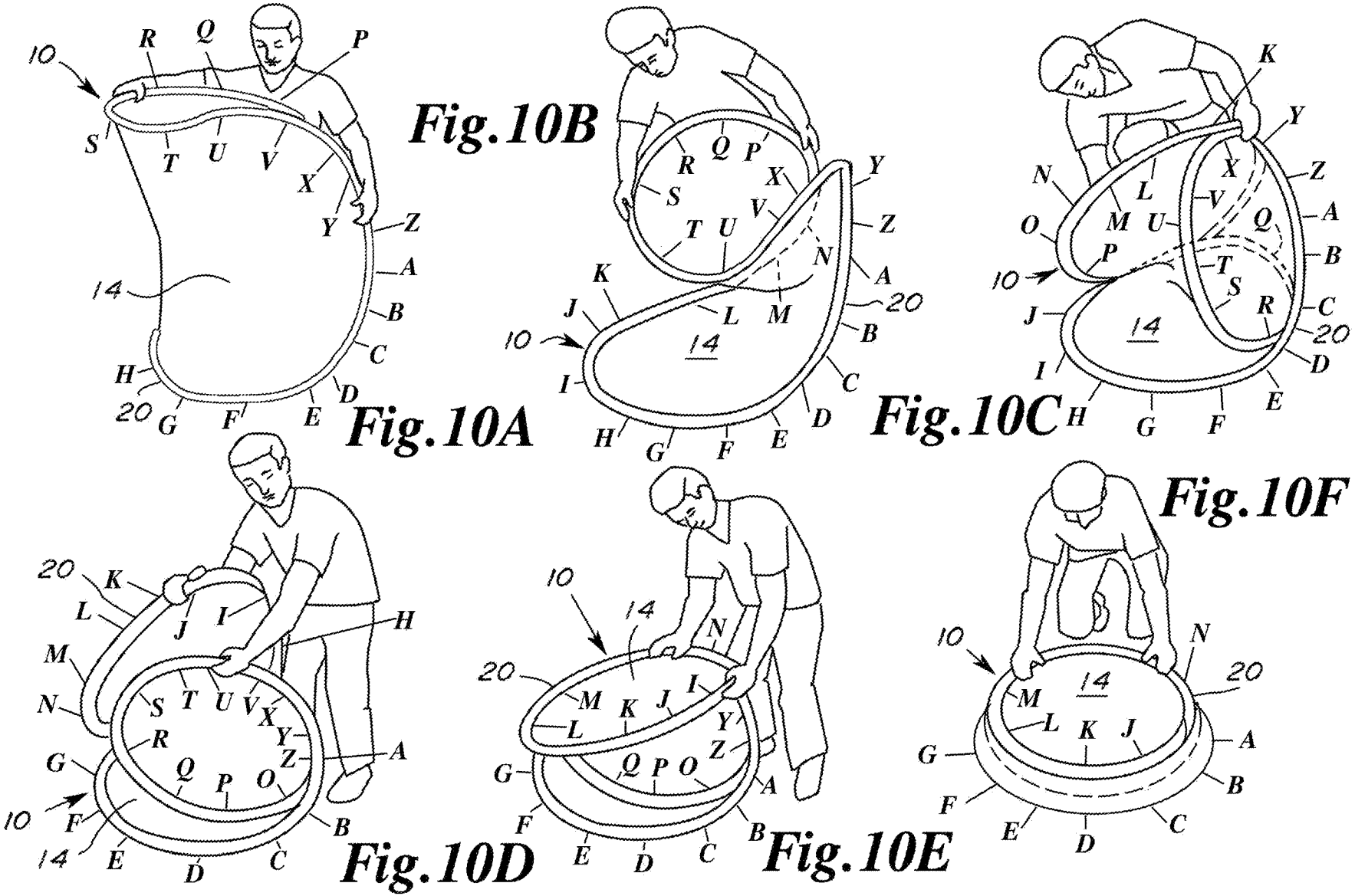
FIG. 10A is a diagrammatic view of a first step for folding the canopy of FIG. 1A to a compact state.
FIG. 10B is a diagrammatic view of a second step for folding the canopy of FIG. 1A to a compact state.
FIG. 10C is a diagrammatic view of a third step for folding the canopy of FIG. 1A to a compact state.
FIG. 10D is a diagrammatic view of a fourth step for folding the canopy of FIG. 1A to a compact state.
FIG. 10E is a diagrammatic view of a fifth step for folding the canopy of FIG. 1A to a compact state.
FIG. 10F is a diagrammatic view of a sixth and final step for folding the canopy of FIG. 1A to a compact state, where

FIGS. 10A through 10F show one way to fold the canopy to the compact state of FIG. 10F. In the flat form of FIGS. 1A and 1B, the bends of resilient element 16 are all gradual and curved and the resilient element 16 includes no crease or crimp. In the compact state of FIG. 10F, the bends of resilient element 16 are all gradual and curved and the resilient element 16 includes no crease or crimp.

In each of FIGS. 10A, 10B, 10C, 10D, 10E, and 10F, the bends of resilient element 16 are all gradual and curved and the resilient element 16 includes no crease or crimp. In the entire transition from the flat state shown in FIGS. 1A and 1B to the state shown in FIG. 10A, to the state shown in FIG. 10B, to the state shown in FIG. 10C, to the state shown in FIG. 10D, to the state shown in FIG. 10E, and to the state shown in FIG. 10F, the bends of resilient element 16 are all gradual and curved with the resilient element 16 having no crease or crimp.

In the entire transition from the compact state shown in FIG. 10F, to the state shown in FIG. 10E, to the state shown in FIG. 10D, to the state shown in FIG. 10C, to the state shown in FIG. 10B, to the state shown in FIG. 10A, the bends of resilient element 16 are all gradual and curved with the resilient element 16 having no crease or crimp.

In FIGS. 10A, 10B, 10C, 10D, 10E, and 10F, the alphabetical characters A through Z are listed in order on the endless envelope 20. The alphabetical characters A through Z represent segments but are not intended to show equal segments or identical locations on the envelope 20. In other words, is it not intended that the point H in any of the FIGS. 10A to 10F shows the exact same location in any of the other FIGS. 10A to 10F but only a generally same location. The purpose of the alphabetical characters A through Z is to track the line or train of the endless envelope 20 and its interiorly located resilient element 16 and to show how three circular unit portions are formed from a flat form of the canopy 10.

In FIG. 10A, the ends 22 of the canopy 10 are drawn together. From FIG. 10A to FIG. 10B, a middle portion of the canopy 10 is manipulated to extend rearwardly. From FIG. 10B to FIG. 10C, a circular unit portion having the alphabetical characters R-S-T is pushed downwardly and to the left of the user, which motion produces for the first time three distinct circular unit portions of the endless envelope 20 and resilient element 16. From FIG. 10C to FIG. 10D, the circular unit portion having alphabetical characters R-S-T is pushed between a bottom circular unit portion having characters D-E-F and a top circular unit portion having alphabetical characters K-L-M. From FIG. 10D to FIG. 10E, the middle unit portion having alphabetical characters O-P-Q may be released and only the top unit portion having the alphabetical characters K-L-M may be held. From FIG. 10E to FIG. 10F, the top unit portion having the alphabetical characters K-L-M is pushed further down to form the compact state of FIG. 10F where all circular unit portions are adjacent to each other with gradual bends in the resilient element 16, with curved bends in the resilient element 16, and with no creases or crimps in the resilient element 16. Canopy 10, in its compact form of FIG. 10F, may be placed in a box or may be held in such a compact state by one or more rubber binders extending diametrically around the three circular unit portion bundle. It should be noted that the canopy 10 remains in the compact form shown in FIG. 10F, where the circular unit portions are adjacent to each other and generally share a common axis, without the aid of any outside source such as a box or rubber binder until one or more circular unit portions are pushed away and out of alignment from the other circular unit portions, whereupon the canopy 10 may resiliently and automatically return to the generally flat form of FIGS. 1A and 1B.

FIG. 11 shows the folded in, compact state of the cube shaped playyard 62 where upper junctions 84 are adjacent to each other, where lower junctions 86 are adjacent to each other, and where the over center lock apparatus 88 takes an inverted V shape. In folding from the folded out operating state of FIG. 7A, ears 118 may remain engaged to upper junctions 84.

Figure 12A:
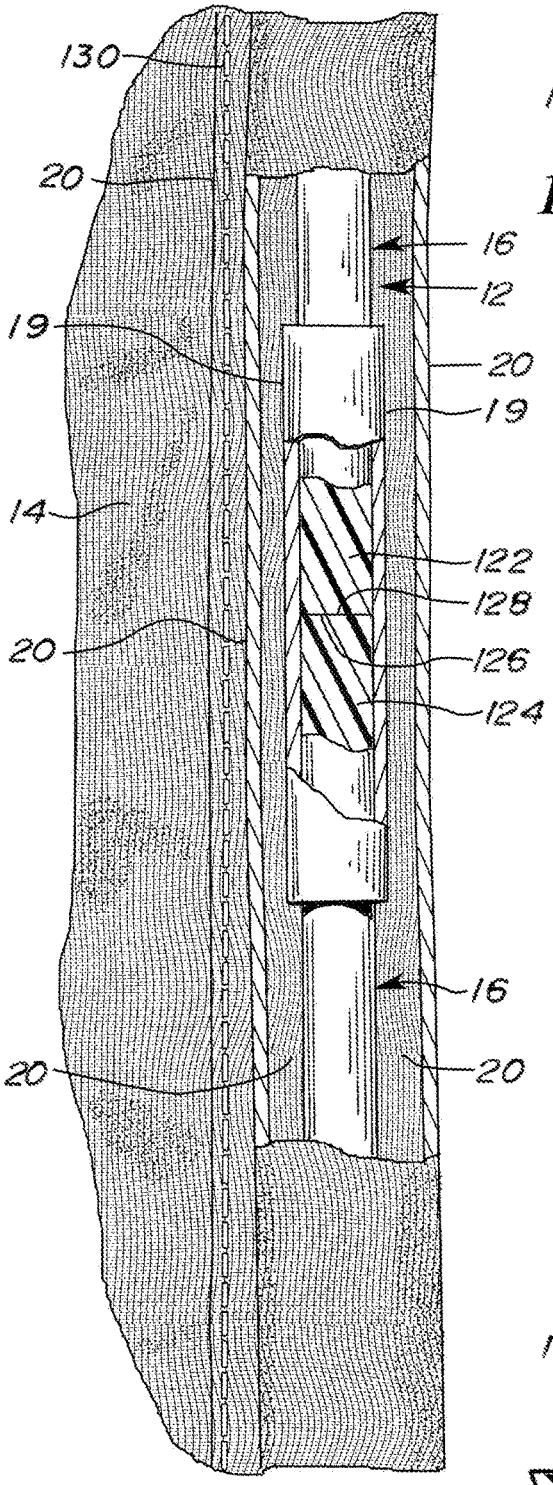
FIG. 12A is a section view of a peripheral portion of the canopy of FIG. 1A showing a section of the envelope that houses the resilient element and further showing ends of the resilient element.
Figure 12B:
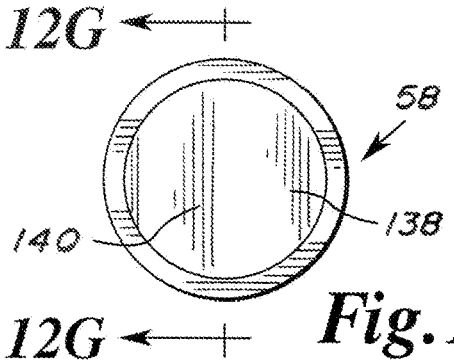
FIG. 12B is a top view of magnetic disk assembly that is housed in the apex portions of the flaps of the canopy of FIG. 1B.
Figure 12C:
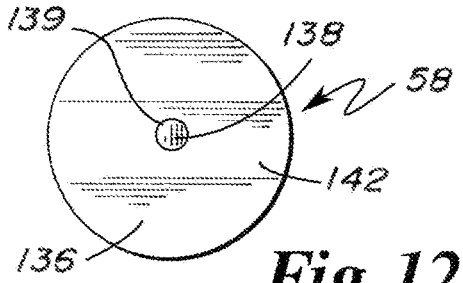
FIG. 12C is a bottom view of the magnetic disk assembly of FIG. 12B.
Figure 12D:
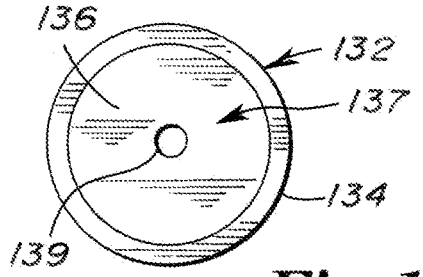
FIG. 12D is a top isolated view of the non-magnetic receptacle portion of the magnetic disk assembly of FIG. 12B.

FIG. 12A shows that end portions 122, 124 of the resilient element 16 have respective end faces 126, 128 that abut each other or that are adjacent to each other. End portions 122, 124 are engaged by the metal tube 19. End portions 122, 124 may be engaged in tube 19 by a friction fit or by adhesive such that end portions 122, 124 are not slideable out of tube 19. However, such friction fit and adhesive is not necessary because the end portions 122, 124 remain in the tube or coupler 19 by the natural outward tension supplied by the resilient element 16. Resilient element 16 may be formed of one or more segments. If resilient element 16 is formed by one segment, then only one tube 19 is required. If resilient element 16 is formed by two segments, then two tubes 19 are required. If resilient element 16 is formed by three segments, then three tubes 19 are required. Tube 19 is preferably rigid and not flexible, though tube 19 may be flexible or resilient if desired. Tube 19 have a straight axis or such axis may be slightly curved. Resilient element 16 and tube 19 can slip or slide somewhat in the envelope or sleeve 20. FIG. 12A further shows the envelope 20 and stitching 130 where the envelope 20 is engaged to the sheeting 14.

Figure 12E:
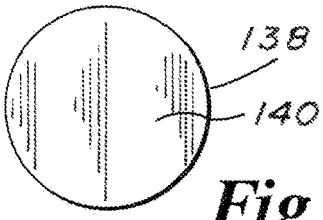
FIG. 12E is a top isolated view of the magnetic disk shaped piece of the magnetic disk assembly of FIG. 12B.
Figure 12F:
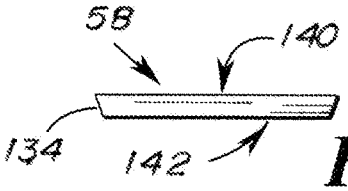
FIG. 12F is a side view of the magnetic disk assembly of FIG. 12B.
Figure 12G:
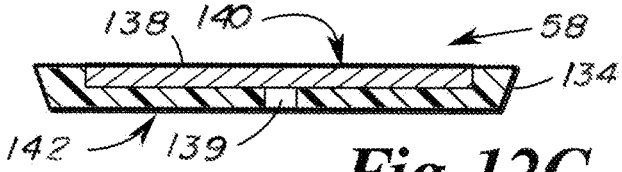
FIG. 12G is a section view of the magnetic disk assembly at lines 12G-12G of FIG. 12B.

FIGS. 12B, 12C, 12D, 12E, and 12F relate to the magnetic disk assembly 58. Magnetic disk assembly 58 is shown in FIGS. 12B, 12C, and 12F. Magnetic disk assembly 58 includes a non-magnetic receptacle metallic portion 132 shown in FIG. 12D. Non-magnetic receptacle portion 132 includes an endless circular sidewall 134 and a disk shaped floor 136. Floor 136 and sidewall 134 are integral and one-piece with each other and form a receptacle 137. Floor 136 includes a central through opening 139. FIG. 12E shows a magnetic disk shaped piece 138 that is engaged in the receptacle 137. Piece 138 may be engaged by friction fit, by adhesive, or by welding in the receptacle 137. Magnetic disk assembly 58 includes a relatively strong magnetic pull or engagement at the open free face 140. Magnetic disk assembly 58 includes a relatively weak magnetic pull or engagement at the closed face 142 where the magnetic piece 138 is covered by floor 136 except for opening 139. When flaps 36, 40 are arranged as shown in FIG. 3, with flap 36 over flap 40, the open free faces 140 are oriented toward each other and the closed faces 142 are oriented away from each other. That is, the free face 140 of the magnetic disk assembly 58 of flap 36 faces toward the inside of the playyard 62 and the free face 140 of the magnetic disk assembly 58 of flap 40 faces toward the outside of the playyard 62. Likewise, since flap 42 partially overlaps flap 38 when the canopy 10 is in the position of FIG. 3, the open free faces 140 are oriented toward each other and the closed faces 142 are oriented away from each other. That is, the free face 140 of the magnetic disk assembly 58 of flap 42 faces toward the inside of the playyard 62 and the free face 140 of the magnetic disk assembly 58 of flap 38 faces toward the outside of the playyard 62.

Figure 13:
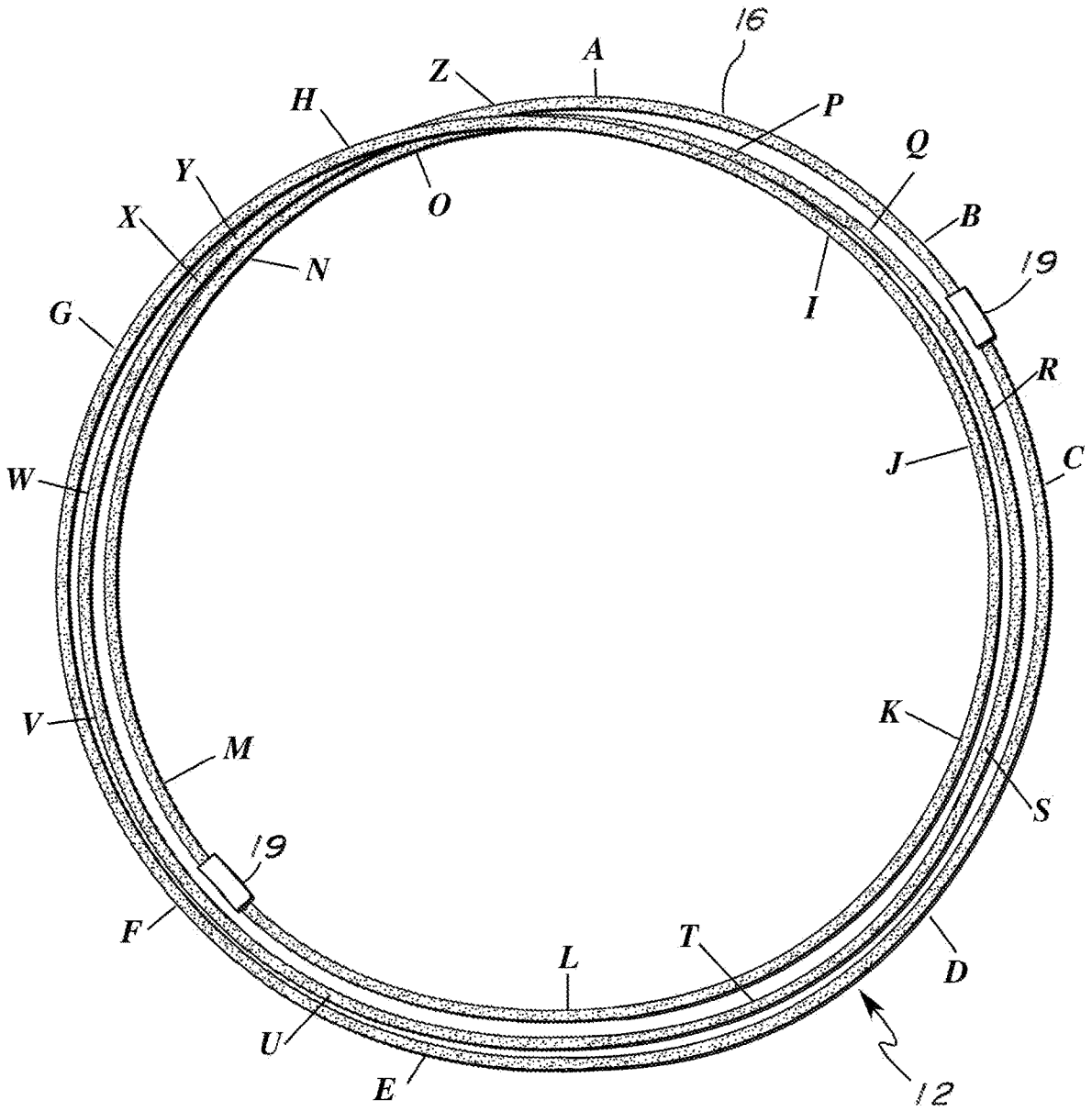
FIG. 13 is an isolated top view of the resilient element of the FIG. 1A in a compact form without the sheeting of the canopy of FIG. 1A.

FIG. 13 shows the resilient frame 12 without sheeting 14. Resilient frame 12 includes the resilient element 16 and the tube couplers 19. Resilient element 16 includes two resilient portions or segments engaged end to end by tube couplers 19. FIG. 13 shows the compact form of FIG. 10F spread out to make visible the endless feature of the resilient element 16. The endless feature of the resilient element 16 is shown by the alphabetical characters.

In FIG. 13, the resilient element 16 extends from location A to location B, then extends to a coupler 19, then extends to location C to location D to location E to location G to location H, then passes over a portion of the resilient element 16, then passes over another portion of the resilient element 16, then extends to location I to location J to location K to location L, then extends to the other coupler 19, then extends to location M to location N to location O, then passes under a portion of the resilient element 16, then extends to location P to location Q to location R to location S to location T to location U to location V to location W to location X to location Y, then passes under a portion of the resilient element 16, then extends to location Z and then extends back to location A.

In FIG. 13, locations A to H define a circular outer portion, locations I to O define a circular inner portion, and locations P to Y define a circular intermediate portion.

When the resilient element 16 is in the form shown in FIG. 13 or in the compact form shown in FIG. 10F, the resilient element 16 does not snap back to the elongate form shown in FIG. 1A and FIG. 1B, until one or more of the three circular portions is moved up, down, sideways, or obliquely to a point, whereupon the resilient element 16 snaps back to such elongate form of FIGS. 1A and 1B.

In operation, a user may begin with the canopy 10 in the compact form shown in FIG. 10F and the playyard 62 in the compact form shown in FIG. 11. The playyard 62 is expanded by pushing apart the adjacent upper junctions 84. As such is done, the endless frame 64 begins to scissor or fold out. When the endless frame 64 is almost fully scissored out, one over-center lock apparatus 88 is stepped upon to lock the over-center lock apparatus 88 to further scissor out the endless frame 64. Then the other over-center lock apparatus 88 is stepped upon to lock this second over-center lock apparatus 88 to fully fold out the endless frame 64. Prior to or after such locking, the proximal ends 110 of one or more straps 104 may be pulled to tighten the strap 104 to draw the floor 67 further taut. And/or prior to or after such locking, one or more of the buckles 114 may be manipulated to loosen its respective strap 104 to extend the effective length of intermediate strap section 108 so as to render the floor 67 less taut. If necessary, prior to such locking, one or more ears 118 may need to be engaged to the respective upper junction 84.

Then the canopy 10 may be released from the compact state shown in FIG. 10F by lifting up on the upper circular unit portion having the alphabetical characters K-L-M, whereupon the canopy 10 resiliently expands to the flat form shown in FIGS. 1A and 1B. Then the magnetic disk assemblies 58 are disengaged from each other such that flaps 36, 38, 40, and 42 are disengaged from each other. Then the canopy 10 may be lifted up and carried to the playyard 62 where one end 22 of the canopy 10 is tucked between the upper portions of support members 70, 72 and sidewall 66 and brought to be adjacent to intermediate junction 73, whereupon the toggle closure 25 is engaged across the intermediate junction 73. Then the user resiliently bends the canopy 10 over the open top 71 of the playyard 62 and tucks the other end 22 of the canopy 10 between the upper portions of the support members 70, 72 and sidewall 66 on the other side of the playyard 62 and brings such end 22 to be adjacent to the intermediate junction 73 on such side, whereupon the other toggle closure 25 is engaged across the intermediate junction 73. Then flaps 36, 40 are engaged by the magnetic disk assemblies 58 (one or more of which are magnetic) and the flaps 38, 42 are engaged by their respective magnetic disk assemblies 58 (one or more of which are magnetic). Then the four elastic portions 60 are stretched and engaged under their respective upper junctions 84.

In operation, to place a child in the playyard 62, one set of flaps, such as flaps 36, 40, may be opened and the apex portion 54 tossed onto the top of the canopy 10 after disengaging the respective elastic portions 60 from the upper junctions 84. Then the child may be lifted up and over the sidewall 66 and placed on the floor 67, which may or may not have a mat thereon. Then the flaps 36, 40 may be engaged to each other by the magnetic disk assemblies 58, whereupon the enclosure or playyard-canopy combination is generally bug free because the flaps 36, 38, 40, 42 are adjacent to a portion of the horizontal strip 100 and because the canopy 10 itself is adjacent to the remaining portion of the horizontal strip 100. In other words, the canopy 10 covers, with flaps 36, 38, 40, 42 and the sheeting 10, the entire open top 71 of the playyard 62.

In operation, all of the flaps 36, 38, 40, 42 may be closed and engaged with magnetic disk assemblies 58. Or all of the flaps 36, 38, 40, 42 may be closed but not engaged to each other with magnetic disk assemblies 58. Or one or more flaps 36, 38, 40, 42 may be open such as where their respective apex portion 54 and embedded magnetic disk assembly are resting on top of the canopy 10 and the remaining flaps 36, 38, 40, 42 closed. FIG. 5A shows one combination where certain flaps 36, 38, 40, 42 may be open and other certain flaps 36, 38, 40, 42 may be closed. FIG. 5B shows another combination where all of the flaps 36, 38, 40, 42 are open. There are other combinations as well, such as where diagonally opposing flaps 38 and 40 are open and diagonally opposing flaps 36 and 42 are closed.

In operation, the playyard-canopy combination provides shade to the child on the floor 67. The mesh sidewall 66 provides shade. The sheeting 14, which is not see-through, provides shade. The flaps 36, 38, 40, 42 provide shade by the non-see-through portions 52 and by the mesh windows 50. At the same time, the playyard-canopy combination provides a great amount of ventilation by the mesh sidewall 66 of the playyard 62 and by the mesh windows 50 of the canopy 10. At the same time, the playyard-canopy combination provides protection from the rain by the non-see-through sheeting 14.

In operation, the playyard-canopy combination is stable. The playyard 62 provides a stable base to the canopy 10 by having a metal frame 64 provided by support members 70, 72. The canopy 10 is securely held to the playyard 62 by the opposing toggle closures 25 on each of the ends 22 of the canopy 10 and by the elastic portions 60 holding sides 24 of the canopy 10 to the upper junctions 84 of the playyard 62. Further, with magnetic disk assemblies 58 engaging adjacent flaps 36, 40 and 38, 42, elastic portions 60 are further fixed in place underneath the upper junctions 84.

In operation, to take down the playyard-canopy combination, the canopy 10 is removed from the playyard 62 by disengaging the flaps 36, 40 from each other, by disengaging flaps 38, 42 from each other, by disengaging the elastic portions 60 from their respective upper junctions 84, by disengaging the toggle closures 25 from the intermediate junction, and by lifting the canopy ends 22 off the intermediate junctions 73. Then the opposing flaps 40, 42 are engaged to each other by their respective magnetic disk assemblies 58 and flaps 36, 38 are engaged to each other by their respective magnetic disk assemblies 58 to place the canopy 10 in the relatively flat form shown in FIG. 1B. Then the steps shown in FIGS. 10A, 10B, 10C, 10D, 10E, and 10F may be carried out to place the canopy 10 in the compact form shown in FIG. 10F, whereupon the compact canopy 10 may be placed in a box. Then the playyard 62 is unlocked by lifting up the center pieces 92 of the over-center lock apparatus 88 with the upper portion of the foot, whereupon the frame 64 is scissored in to draw the upper junctions 84 adjacent to each other and the lower junctions 86 adjacent to each other. In the folding in process, straps 104 may or may not be loosened by manipulating buckles 114.

It should be noted that the length of the canopy 10 is about 82 inches (six feet, ten inches), that the width of the canopy is about 30 inches (two feet, six inches), that the thickness of the sheeting 14 is the about the thickness of a bed sheet, and that the thickness of the resilient element 16 is about between one-sixteenth of an inch and about one-eighth of an inch. When the resilient element 16 stands alone, apart from the sheeting 14, such as when the resilient element 16 expands from the form shown in FIG. 13, the resilient element 16 defines a circle with a diameter of about 63 inches (five feet, three inches).

Canopy 10 may be folded the following way to obtain the result of FIG. 10F or FIG. 13: 1) place the canopy 10 flat against a wall with a first person holding one end of the canopy 10 and a second person holding the other, opposite end of the canopy 10, wherein the inner face 34 is adjacent to the wall and the outer face 32 is facing the first and second persons, and wherein opposing flaps 40, 42 are magnetically engaged and wherein opposing flaps 36, 38 are magnetically engaged, then 2) the first person twists one end of the canopy 10 such that an upper portion of the resilient element 16 crosses over a lower portion of the resilient element 16 to form a first cross over location such that the first person holds about a first one-third portion of outer face 32 against the wall, wherein the first person pinches the first cross over location, then 3) the second person twists the opposite end of the canopy 10 such that a lower portion of the resilient element 16 crosses over an upper portion of the resilient element 16 to form a second cross over location such that the second person holds about a second one-third portion of outer face 32 against the wall, wherein the second person pinches the second cross over location, wherein where at this point in time the canopy 10 has a first cross over location, a second cross over location, and an intermediate canopy portion between the first and second cross over locations, then 4) the first person folds the first one-third portion on top of the intermediate canopy portion such that the inner face 34 of the first one-third portion faces the outer face 32 of the intermediate canopy portion, then 5) the second person folds the second one-third portion to the inner face 34 of the intermediate canopy portion such that the outer face 32 of the second one-third portion faces the inner face 34 of the intermediate canopy portion, whereupon the form of FIG. 10F and FIG. 13 is obtained. In sum, a) a first end of the canopy 10 is twisted 180 degrees one way, b) the second end of the canopy 10 is twisted 180 degrees the other way, c) the first end is folded upon a top of an intermediate canopy portion between the first and second ends, and d) the second end is folded underneath and onto the bottom of the intermediate canopy portion, whereupon the form of FIG. 10F and FIG. 13 is obtained.

It should be noted that sheeting 14 may be a flexible fabric such as polyester. Flaps 36, 38, 40, 42 may be a flexible fabric such as polyester.

It should be noted that resilient element 16 may be formed of or include steel such as stainless steel.

It should be noted that the canopy 10 may be referred to as a spring canopy 10. Canopy 10 can spring out from the U-shaped form shown in FIGS. 2 and 3 to the flat form shown in FIGS. 1A and 1B. Once nudged, canopy 10 can spring out from the three unit circular form shown in FIGS. 10F and 13 to the flat form shown in FIGS. 1A and 1B.

The horizontal edge portion 48 of the first flap 36 intersects the sheeting 14 at a first location. The first location is adjacent to and spaced from the first end 22 of the sheeting 14 in the second form shown in FIG. 2. The horizontal edge portion 48 of the third flap 40 intersects the sheeting 14 at a second location. The second location is adjacent to and spaced from the second end 22 of the sheeting 14 in the second form shown in FIG. 2. The horizontal edge portion 48 of the second flap 38 intersects the sheeting 14 at a third location. The third location is adjacent to and spaced from the first end 22 of the sheeting 14 in the second form shown in FIG. 2. The horizontal edge portion 48 of the fourth flap 42 intersects the sheeting 14 at a fourth location. The fourth location is adjacent to and spaced from the second end 22 of the sheeting 14 in the second form such that a first opening is formed below the horizontal edge portions 48 of the first and third flaps 36, 40 and such that a second opening is formed below the horizontal edge portions 48 of the second and fourth flaps 38, 42. The first opening is defined by the sheeting 14 and first and third flaps 36, 40. The second opening is defined by the sheeting 14 and second and fourth flaps 38, 42. The first and second openings have dimensions that are the same.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A canopy comprising:

a) a sheeting;

b) the sheeting having first and second ends;

c) the sheeting having first and second sides;

d) the sheeting extending from the first end to the second end and from the first side to the second side;

e) the sheeting having an elongate shape;

f) the sheeting having a resilient element engaged thereto, the resilient element extending about a perimeter of the sheeting, the resilient element being generally endless;

g) the sheeting having a first form that is generally a flat form, the first and second ends being spaced apart in the first form;

h) the sheeting having a second form that defines the shape of a U, the first and second ends being spaced apart from each other in the second form, the first and second ends being closer to each other in the second form than in the first form;

i) the sheeting having a third form where the resilient element defines three generally circular shapes adjacent to each other;

j) first, second, third, and fourth flaps, the first and third flaps engaged to the first side of the sheeting, the second and fourth flaps engaged to the second side of the sheeting, the first flap opposing the second flap in the second form, the third flap opposing the fourth flap in the second form, the first and third flaps engagable to each other in the second form, and the second and fourth flaps engagable to each other in the second form;

k) the first and third flaps having respective vertical edge portions that are disposed adjacent to each other in the second form, the second and fourth flaps having respective vertical edge portions that are disposed adjacent to each other in the second form, each of the vertical edge portions having an uppermost end engaged to the sheeting;

l) The first and third flaps having respective horizontal edge portions that are disposed generally in line with each other in the second form, the second and fourth flaps having respective horizontal edge portions that are disposed generally in line with each other in the second form;

m) the first flap having a curved edge portion engaged to the sheeting and extending from the vertical edge portion of the first flap to the horizontal edge portion of the first flap in the second form, the second flap having a curved edge portion engaged to the sheeting and extending from the vertical edge portion of the second flap to the horizontal edge portion of the second flap in the second form, the third flap having a curved edge portion engaged to the sheeting and extending from the vertical edge portion of the third flap to the horizontal edge portion of the third flap in the second form, the fourth flap having a curved edge portion engaged to the sheeting and extending from the vertical edge portion of the fourth flap to the horizontal edge portion of the fourth flap in the second form;

n) the vertical edge portion of the first flap overlapping the vertical edge portion of the third flap in the second form, the vertical edge portion of the second flap overlapping the vertical edge portion of the fourth flap in the second form;

o) the horizontal edge portion of the first flap intersecting the sheeting at a first location, the first location being adjacent to and spaced from the first end of the sheeting in the second form, the horizontal edge portion of the third flap intersecting the sheeting at a second location, the second location being adjacent to and spaced from the second end of the sheeting in the second form, the horizontal edge portion of the second flap intersecting the sheeting at a third location, the third location being adjacent to and spaced from the first end of the sheeting in the second form, the horizontal edge portion of the fourth flap intersecting the sheeting at a fourth location, the fourth location being adjacent to and spaced from the second end of the sheeting in the second form such that a first opening is formed below the horizontal edge portions of the first and third flaps and such that a second opening is formed below the horizontal edge portions of the second and fourth flaps, with the first opening being defined by the sheeting and first and third flaps and with the second opening being defined by the sheeting and second and fourth flaps, the first and second openings having dimensions that are the same;

p) each of the first, second, third, and fourth flaps being vertical in the second form; and q) in the second form each of the horizontal edge portions being straight from the sheeting to a location where said horizontal edge portion terminates.

2. The canopy of claim 1, wherein the vertical edge portion of the first flap engages the vertical edge portion of the third flap at a single location, and wherein the vertical edge portion of the second flap engages the vertical edge portion of the fourth flap at a single location.

3. The canopy of claim 1, wherein the vertical edge portion of the first flap engages the vertical edge portion of the third flap at no more than a single location, and wherein the vertical edge portion of the second flap engages the vertical edge portion of the fourth flap at no more than a single location.

4. The canopy of claim 1, wherein the vertical edge portion of the first flap is free of the vertical edge portion of the third flap except at a single location where the first flap engages the third flap, and wherein the vertical edge portion of the second flap is free of the vertical edge portion of the fourth flap except at a single location where the second flap engages the fourth flap.

5. The canopy of claim 1, wherein in the flat form the first side of the sheeting includes first and second straight portions and the second side of the sheeting includes third and fourth straight portions, wherein in the flat form the first end of the sheeting includes first and second curved portions and the second end of the sheeting includes third and fourth curved portions, wherein in the flat form the first straight portion leads into the first curved portion at a first transition, wherein in the flat form the second straight portion leads into the second curved portion at a second transition, wherein in the flat form the third straight portion leads into the third curved portion at a third transition, and wherein in the flat form the fourth straight portion leads into the fourth curved portion at a fourth transition, wherein the first transition is adjacent to the first location, wherein the second transition is adjacent to the second location, wherein the third transition is adjacent to the third location, and wherein the fourth transition is adjacent to the fourth location.

6. A canopy comprising:

a) a sheeting;

b) the sheeting having first and second ends;

c) the sheeting having first and second sides;

d) the sheeting extending from the first end to the second end and from the first side to the second side;

e) the sheeting having an elongate shape;

f) the sheeting having a resilient element engaged thereto, the resilient element extending about a perimeter of the sheeting, the resilient element being generally endless;

g) the sheeting having a first form that is generally a flat form, the first and second ends being spaced apart in the first form;

h) the sheeting having a second form that defines the shape of a U, the first and second ends being spaced apart from each other in the second form, the first and second ends being closer to each other in the second form than in the first form;

i) the sheeting having a third form where the resilient element defines three generally circular shapes adjacent to each other;

j) first, second, third, and fourth flaps, the first and third flaps engaged to the first side of the sheeting, the second and fourth flaps engaged to the second side of the sheeting, the first flap opposing the second flap in the second form, the third flap opposing the fourth flap in the second form, the first and third flaps engagable to each other in the second form, and the second and fourth flaps engagable to each other in the second form;

k) the first and third flaps having respective vertical edge portions that are disposed adjacent to each other in the second form, the second and fourth flaps having respective vertical edge portions that are disposed adjacent to each other in the second form, each of the vertical edge portions having an uppermost end engaged to the sheeting;

l) The first and third flaps having respective horizontal edge portions that are disposed generally in line with each other in the second form, the second and fourth flaps having respective horizontal edge portions that are disposed generally in line with each other in the second form;

m) the first flap having a curved edge portion engaged to the sheeting and extending from the vertical edge portion of the first flap to the horizontal edge portion of the first flap in the second form, the second flap having a curved edge portion engaged to the sheeting and extending from the vertical edge portion of the second flap to the horizontal edge portion of the second flap in the second form, the third flap having a curved edge portion engaged to the sheeting and extending from the vertical edge portion of the third flap to the horizontal edge portion of the third flap in the second form, the fourth flap having a curved edge portion engaged to the sheeting and extending from the vertical edge portion of the fourth flap to the horizontal edge portion of the fourth flap in the second form;

n) the vertical edge portion of the first flap overlapping the vertical edge portion of the third flap in the second form, the vertical edge portion of the second flap overlapping the vertical edge portion of the fourth flap in the second form;

o) the horizontal edge portion of the first flap intersecting the sheeting at a first location, the first location being adjacent to and spaced from the first end of the sheeting in the second form, the horizontal edge portion of the third flap intersecting the sheeting at a second location, the second location being adjacent to and spaced from the second end of the sheeting in the second form, the horizontal edge portion of the second flap intersecting the sheeting at a third location, the third location being adjacent to and spaced from the first end of the sheeting in the second form, the horizontal edge portion of the fourth flap intersecting the sheeting at a fourth location, the fourth location being adjacent to and spaced from the second end of the sheeting in the second form;

p) each of the first, second, third, and fourth flaps being vertical in the second form; and q) in the second form each of the horizontal edge portions being straight from the sheeting to a location where said horizontal edge portion terminates.

7. The canopy of claim 6, wherein the vertical edge portion of the first flap engages the vertical edge portion of the third flap at a single location, and wherein the vertical edge portion of the second flap engages the vertical edge portion of the fourth flap at a single location.

8. The canopy of claim 6, wherein the vertical edge portion of the first flap engages the vertical edge portion of the third flap at no more than a single location, and wherein the vertical edge portion of the second flap engages the vertical edge portion of the fourth flap at no more than a single location.

9. The canopy of claim 6, wherein the vertical edge portion of the first flap is free of the vertical edge portion of the third flap except at a single location where the first flap engages the third flap, and wherein the vertical edge portion of the second flap is free of the vertical edge portion of the fourth flap except at a single location where the second flap engages the fourth flap.

10. The canopy of claim 6, wherein in the flat form the first side of the sheeting includes first and second straight portions and the second side of the sheeting includes third and fourth straight portions, wherein in the flat form the first end of the sheeting includes first and second curved portions and the second end of the sheeting includes third and fourth curved portions, wherein in the flat form the first straight portion leads into the first curved portion at a first transition, wherein in the flat form the second straight portion leads into the second curved portion at a second transition, wherein in the flat form the third straight portion leads into the third curved portion at a third transition, and wherein in the flat form the fourth straight portion leads into the fourth curved portion at a fourth transition, wherein the first transition is adjacent to the first location, wherein the second transition is adjacent to the second location, wherein the third transition is adjacent to the third location, and wherein the fourth transition is adjacent to the fourth location.

* * * * *